US007291434B2

(12) United States Patent
Ishiyama et al.

(10) Patent No.: US 7,291,434 B2
(45) Date of Patent: Nov. 6, 2007

(54) TONER FOR ELECTROSTATICALLY CHARGED IMAGE DEVELOPMENT, MANUFACTURING METHOD THEREOF, IMAGE FORMING METHOD, AND IMAGE FORMING APPARATUS USING THE IMAGE FORMING METHOD

(75) Inventors: Takao Ishiyama, Minamiashigara (JP); Masakazu Iijima, Minamiashigara (JP); Tomohito Nakajima, Minamiashigara (JP); Satoshi Yoshida, Minamiashigara (JP); Eisuke Iwazaki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 341 days.

(21) Appl. No.: 10/870,028

(22) Filed: Jun. 18, 2004

(65) Prior Publication Data

US 2005/0130053 A1 Jun. 16, 2005

(30) Foreign Application Priority Data

Dec. 12, 2003 (JP) ..... 2003-414588

(51) Int. Cl.
*G03G 9/08* (2006.01)

(52) U.S. Cl. ..... 430/108.8; 430/111.4; 430/137.14; 430/124.1; 430/123.5

(58) Field of Classification Search ..... 430/108.8, 430/111.4, 137.14, 124.1, 123.5
See application file for complete search history.

(56) References Cited

U.S. PATENT DOCUMENTS

2002/0160291 A1* 10/2002 Yaguchi et al. ..... 430/108.8
2003/0134216 A1* 7/2003 Kawanishi et al. ..... 430/108.8

FOREIGN PATENT DOCUMENTS

| | | |
|---|---|---|
| JP | A 59-218459 | 12/1984 |
| JP | A 59-218460 | 12/1984 |
| JP | A 63-282752 | 11/1988 |
| JP | A 4-69666 | 3/1992 |
| JP | A 5-61239 | 3/1993 |
| JP | A 6-250439 | 9/1994 |
| JP | A 6-337541 | 12/1994 |
| JP | A 9-258481 | 10/1997 |

* cited by examiner

*Primary Examiner*—Christopher RoDee
(74) *Attorney, Agent, or Firm*—Oliff & Berridge, PLC

(57) ABSTRACT

The present invention provides a toner for electrostatically charged image development comprising at least a binder resin, a colorant and a releasing agent. The releasing agent satisfies the following equations (1) and (2):

$$0.1 \leqq \eta^* a \leqq 1.0 \quad (1)$$

$$1.1 \leqq \eta^* b / \eta^* a \leqq 3.5 \quad (2)$$

wherein η*a represents a complex viscosity (Pa·s) determined from a first dynamic viscoelasticity measurement at a measuring frequency of the releasing agent of 6.28 rad/s, η*b represents a complex viscosity (Pa·s) determined from a second dynamic viscoelasticity measurement at a measuring frequency of the releasing agent of 62.8 rad/s, and each of the first and second dynamic viscoelasticities is measured in a temperature range from a temperature that is 15° C. lower than the melting point of the releasing agent to a temperature that is 15° C. higher than the melting point of the releasing agent.

12 Claims, 1 Drawing Sheet

TONER FOR ELECTROSTATICALLY CHARGED IMAGE DEVELOPMENT, MANUFACTURING METHOD THEREOF, IMAGE FORMING METHOD, AND IMAGE FORMING APPARATUS USING THE IMAGE FORMING METHOD

CROSS-REFERENCE TO RELATED APPLICATION

This application claims priority under 35 USC 119 from Japanese Patent Application No. 2003-414588, the disclosure of which is incorporated by reference herein.

BACKGROUND OF THE INVENTION

1. Field of the Invention

The present invention relates to a toner for electrostatically charged image development used for developing an electrostatic latent image formed by electrophotography or electrostatic recording, a method for manufacturing the toner, an image forming method using the toner for electrostatically charged image development, and an image forming apparatus using the image forming method.

2. Description of the Related Art

A method for visualizing image information via an electrostatic image by, for example, electrophotography has been used in various fields in recent years. An image is visualized in the electrophotographic method through the steps of forming an electrostatic latent image on a photoreceptor by charging and exposing the photoreceptor, developing the electrostatic latent image with a developer containing a toner, and transferring and fusing the image.

A two-component developer including a toner and a carrier, and a one-component developer using only a magnetic or nonmagnetic toner are known as the developer used in the method. The toner contained in the developer is usually produced by a kneading-pulverization method in which a thermoplastic resin is melted and kneaded with a pigment, a charge control agent and a releasing agent such as wax, and the mixture is cooled, pulverized and classified. Inorganic or organic fine particles may be added onto the surface of the toner particles, if necessary, in order to improve fluidity and the cleaning property of the toner. While this method can provide a quite excellent toner, it involves some problems as set forth below.

The shape and surface structure of a toner produced by the conventional kneading-pulverization method becomes irregular. Although subtle changes are possible depending on the pulverizability of the materials used and pulverization conditions, it is difficult to purposely control the shape and surface structure of the toner. Moreover, the range of selection of the materials is restricted in the kneading-pulverization method. Specifically, a dispersion of a resin and a colorant must be pulverizable with an economically practical production apparatus.

However, finer powders may be undesirably generated by a mechanical shear force applied to a toner in a developing apparatus or the shape of the toner may be changed, when the resin colorant is made to be more fragile to satisfy the above requirements. These effects may cause accelerated deterioration of charging characteristics of the developer due to adhesion of the fine powder on the surface of the carrier in the two-component developer, or scattering of the toner due to expanded particle size distribution and deterioration of image quality by a decrease in developability due to the change in the toner shape in the one-component developer.

When a large amount of the releasing agent such as wax is used in producing a toner, the releasing agent is often excessively exposed on the surface of the toner depending on a combination between a thermoplastic binder resin and the releasing agent. Such exposure of the wax on the surface of the toner is evident particularly in a combination between a resin that includes a polymer component to enhance elasticity and that is a little difficult to pulverize and a fragile wax such as polyethylene or polypropylene.

Exposure of the wax component is advantageous for removing the toner from a fusing roll in the fusing process and for washing non-transferred toners from the surface of a photoreceptor. However, the wax component exposed on the surface of the toner may be readily transferred onto a member of an image forming apparatus when a mechanical force is applied onto the toner during use. Accordingly, a development roll, the photoreceptor and the carrier are liable to be contaminated, and thus reliability may decrease.

Furthermore, as described above, the shape of the toner is irregular. Therefore, sufficient fluidity is difficult to obtain even if a fluidizing aid is applied to the toner. Consequently, fine particles added to the surface of the toner move to concave portions on the surface of the toner due to a mechanical shear force during the use of the toner, and fluidity of the toner decreases over time or the fluidizing aid is embedded in the toner to impair developability, transferring property and cleaning property. Image quality may further decrease when a toner retrieved by cleaning is returned to a development unit and used again. However, when the amount of the fluidizing aid added to the toner is increased to prevent such adverse effects, black spots are generated on a photoreceptor and the fluidizing aid particles are scattered.

A method for producing a toner by an emulsification-polymerization aggregation method has been proposed in recent years as a means for enabling the shape and surface structure of the toner to be purposely controlled in order to solve the problems caused by irregularity of the toner shape (see Japanese Patent Application Laid-Open (JP-A) Nos. 63-282752 and 6-250439). In this method, the toner is produced by mixing a dispersion liquid of resin fine particles prepared by emulsification-polymerization and a dispersion liquid in which a colorant is dispersed in a solvent, forming aggregate particles having a diameter corresponding to the diameter of toner particles to be formed, and heating the aggregate particles to fuse and integrate the aggregate particles.

The shape of the toner produced by this method may be controlled to a certain extent, which improves chargability and durability of the toner. However, since the inner structure of the toner becomes almost uniform, removability of a recording medium on which an image is formed from a fusing roll in a fusing process, stabilization of transparency of an image on an OHP sheet, and different charging among colors remain as problems to be solved when an image is formed using the toner.

As described hereinbefore, exposure of the releasing agent on the surface of the toner should be suppressed in order to permit the toner to maintain stable performance under various mechanical stresses, and the surface hardness of the toner should be enhanced to suppress deterioration of fusability of the toner in the image forming method by an electrophotographic process using the toner. In other words, the toner's own mechanical strength should be enhanced, and chargability and fixability of the toner should be compatible at a high level.

Since a demand for high image quality has grown in recent years, the diameter of the toner particles has been remarkably decreased to obtain images of high definition in forming color images. However, the problems of contamination of the carrier and the photoreceptor, and scattering of the toner become evident due to toner particles having an extremely small diameter, when the toner diameter is simply reduced while the particle diameter distribution remains the same. As a result, it is difficult to simultaneously realize high image quality and high reliability. Therefore, the particle diameter distribution should be narrowed while the diameter of the toner particles is reduced.

In digital full-color copiers and printers, colors of a color image manuscript are separated with B (blue), R (red) and G (green) filters to obtain blue image information, red image information and green image information, and latent images which are composed of dots having a diameter in the range of 20 to 70 μm and which correspond to the original manuscript are formed in accordance the image information and developed by taking advantage of a subtractive color mixing using Y (yellow), M (magenta), C (cyan) and Bk (black) developers. However, a larger amount of the developer must be transferred in such a process than in conventional monochromatic printing. Since the development process is required to be able to accurately develop latent images composed of dots having a small diameter, uniform chargability, persistence of the charge, toner strength and sharpness of the particle size distribution are becoming more and more important in recent years.

Low temperature fixability is also required for the toner considering high speed and energy-saving operation of the apparatus. A toner suitable for low temperature fusing may be produced by taking advantage of a method for producing the toner using an emulsification-polymerization aggregation process suitable for producing toner particles having a small diameter.

On the other hand, it is necessary that large amounts of color toners are sufficiently mixed in a full-color printer, and improved color reproducibility and transparency of an image on an OHP sheet are essential for full-color printing.

Meanwhile, a polyolefin wax is usually used as the releasing agent component of the toner in order to prevent low temperature offsetting in the fusing process. A trace of a silicone oil is uniformly applied onto a fusing roll in order to prevent high temperature offsetting in the fusing process. Accordingly, since the silicone oil adheres onto the surface of a recording medium on which an image is formed, the surface gives an unpleasant sticky feeling when the recording medium is handled.

A toner for oilless fusing which contains a large quantity of the releasing agent component has been proposed in order to solve the problems as described above (see JP-A No. 5-061239). Removability of the toner from a fusing member may be improved to a certain extent by adding a large amount of the releasing agent. However, it is difficult to obtain stable removability, since a problem of compatibility between a binder resin and the releasing agent is caused and the releasing agent unevenly bleeds on the surface of the toner. In addition, since the means for controlling aggregation force between the toner and the binder resin depends on the weight average molecular weight Mw and glass transition temperature Tg of the binder resin, it is difficult to directly control spinnability and coagulability of the toner in the coalescence process. Further, free components in the releasing agent may cause inhibition of charging.

In order to solve the problems in oilless fusing, a method for enhancing rigidity of the binder resin by adding a high molecular weight component to the binder (see JP-A Nos. 4-69666 and 9-258481), and a method for improving rigidity of the binder resin by chemically introducing cross-links to the binder so as to eventually decrease spinnability of the toner at a fusing temperature and improve removability of the toner were proposed (see JP-A Nos. 59-218460 and 59-218459).

Various measures for the releasing agent have been investigated and proposed to solve the problems offusability, and particularly removability, of a toner for oilless fusing, transparency of a full color image on an OHP sheet, and/or inhibition of fluidity of the toner powder caused by the releasing agent.

Particularly, a method for using a releasing agent which has a melting point in an intermediate temperature region and which is amorphous or has low crystallinity such as an ester wax has been proposed to improve removability of a recording medium on which an image is formed from a fusing roll at the time of oilless fusing (see JP-A No. 6-337541). According to this proposal, removability of a recording medium on which an image is formed from a fusing roll at the time of oilless fusing is improved by lowering the melt viscosity of the releasing agent, and reduction of transparency of a full color image on an OHP sheet is prevented by using a low crystallinity releasing agent.

However, since the releasing agent component often plasticizes the binder resin component and consequently the Theological property of the binder resin at the time of fusing deteriorates, removability of the toner from a fusing roll of an oilless fusing unit is impaired.

In order to solve the above problems (to suppress a decrease in removability due to plasticization), it becomes inevitable to introduce cross-linking structures into the binder resin, to increase the molecular weight and the glass transition temperature Tg of the binder resin, and/or to add a large quantity of the releasing agent to the toner.

However, countermeasures as described above may often cause a decrease in luster of the image and also decrease transparency of the image on the OHP sheet. In addition, the production cost increases since a large quantity of the releasing agent is required for producing the toner. Furthermore, a releasing agent layer is formed on the image due to a large amount of the releasing agent remaining on the fixed image. The releasing agent layer formed on the image may deteriorate the image quality due to generation of contact traces on the releasing agent layer by contact between a roll for ejecting a recording material out of the image forming apparatus and the image formed on the recording material. Such a phenomenon becomes more evident on an image having higher luster.

Accordingly, there is a need for a toner for electrostatically charged image development which is excellent in removability in oilless fusing, maintains good luster, has excellent fixability such as luster of the surface of a fixed image and transparency of an image on an OHP sheet, can provide images of high definition by suppressing contact traces of ejecting rolls generated in ejecting the fixed image, and renders the image less dependent on an operation environment. Moreover, there is a need for a method for producing such a toner, an image forming method using the toner for electrostatically charged image development, and image forming apparatus using the image forming method.

SUMMARY OF THE INVENTION

The inventors of the invention supposed that a balance between the bleeding property of a releasing agent from a toner at the time of fixing, and the covering property of the releasing agent when the releasing agent which has bled from the toner forms a layer on an image is important. In forming images, a process speed depends on an image forming mode (such as monochromatic image formation or color image formation) and the kind of an apparatus (such as business use or personal use). The inventors also thought that differences between operation environments, which have not been taken into account in selecting a releasing agent, may affect the releasing agent contained in a toner, the bleeding property of the releasing agent, and the property of the releasing agent which property facilitates removal of an image from a fusing roll (hereinafter, the property is called removability). The inventors studied hard, considering these points. As a result, the inventors have completed the invention.

A first aspect of the invention provides a toner for electrostatically charged image development containing at least a binder resin, a colorant and a releasing agent, wherein the releasing agent satisfies the following equations (1) and (2):

$$0.1 \leqq \eta^{*}a \leqq 1.0 \quad (1)$$

$$1.1 \leqq \eta^{*}b/\eta^{*}a \leqq 3.5 \quad (2)$$

wherein η*a represents a complex viscosity (Pa·s) determined from a first dynamic viscoelasticity measurement at a measuring frequency of the releasing agent of 6.28 rad/s, η*b represents a complex viscosity (Pa·s) determined from a second dynamic viscoelasticity measurement at a measuring frequency of the releasing agent of 62.8 rad/s, and each of the first and second dynamic viscoelasticities is measured in a temperature range from a temperature that is 15° C. lower than the melting point of the releasing agent to a temperature that is 15° C. higher than the melting point of the releasing agent.

A second aspect of the invention provides a toner for electrostatically charged image development comprising at least a binder resin, a colorant and a releasing agent, wherein the releasing agent contains polyalkylene and satisfies the following equations (1) and (2):

$$0.1 \leqq \eta^{*}a \leqq 1.0 \quad (1)$$

$$1.1 \leqq \eta^{*}b/\eta^{*}a \leqq 3.5 \quad (2)$$

wherein ηa represents a complex viscosity (Pa·s) determined from a first dynamic viscoelasticity measurement at a measuring frequency of the releasing agent of 6.28 rad/s, ηb represents a complex viscosity (Pa·s) determined from a second dynamic viscoelasticity measurement at a measuring frequency of the releasing agent of 62.8 rad/s, and each of the first and second dynamic viscoelasticities is measured in a temperature range from a temperature that is 15° C. lower than the melting point of the releasing agent to a temperature that is 15° C. higher than the melting point of the releasing agent.

A third aspect of the invention provides a toner for electrostatically charged image development comprising at least a binder resin, a colorant and a releasing agent, wherein the releasing agent contains polyalkylene and satisfies the following equations (1) and (2):

$$0.1 \leqq \eta^{*}a \leqq 1.0 \quad (1)$$

$$1.1 \leqq \eta^{*}b/\eta^{*}a \leqq 3.5 \quad (2)$$

wherein η*a represents a complex viscosity (Pa·s) determined from a first dynamic viscoelasticity measurement at a measuring frequency of the releasing agent of 6.28 rad/s, η*b represents a complex viscosity (Pa·s) determined from a second dynamic viscoelasticity measurement at a measuring frequency of the releasing agent of 62.8 rad/s, and each of the first and second dynamic viscoelasticities is measured in a temperature range from a temperature that is 15° C. lower than the melting point of the releasing agent to a temperature that is 15° C. higher than the melting point of the releasing agent, and wherein a maximum endothermic determined by differential thermal analysis of the polyalkylene is within a range of 85 to 95° C., a ratio of a sum of endothermic amounts in a temperature range of not higher than 85° C., which sum is calculated from a partial area obtained from an endothermic curve determined by the differential thermal analysis of the polyalkylene, to a sum of endothermic amounts, which is calculated from a total area obtained from the endothermic curve, is within a range of about 5 to about 15%, and the content of the polyalkylene determined based on a maximum endothermic intensity is within a range of about 6 to about 9% by weight.

A fourth aspect of the invention provides a method for producing a toner for electrostatically charged image development, the method comprising: mixing a dispersion liquid of resin fine particles comprising first resin fine particles having a volume average particle diameter of not more than 1 μm, a dispersion liquid of a colorant, and a dispersion liquid of a releasing agent to prepare a mixed solution; adding a coagulant into the mixed solution to form core aggregates; adhering second resin fine particles on the surface of the core aggregates to form core/shell aggregates; and heating the core/shell aggregates to a temperature not lower than the glass transition temperature of the first and/or second resin fine particles to fuse and integrate the core/shell aggregates, wherein the releasing agent satisfies the following equations (1) and (2):

$$0.1 \leqq \eta^{*}a \leqq 1.0 \quad (1)$$

$$1.1 \leqq \eta^{*}b/\eta^{*}a \leqq 3.5 \quad (2)$$

wherein η*a represents a complex viscosity (Pa·s) determined from a first dynamic viscoelasticity measurement at a measuring frequency of the releasing agent of 6.28 rad/s, and η*b represents a complex viscosity (Pa·s) determined from a second dynamic viscoelasticity measurement at a measuring frequency of the releasing agent of 62.8 rad/s.

A fifth aspect of the invention provides an image forming method comprising: uniformly charging a surface of an image holding member; forming an electrostatic latent image on the surface of the uniformly charged image holding member based on image information; developing the electrostatic latent image with a developer containing at least a toner to obtain a toner image; and fusing the toner image on a surface of a recording medium by oilless fusing to form an image on the recording medium, wherein the toner containing at least a binder resin, a colorant and a releasing agent, and the releasing agent satisfies the following equations (1) and (2):

$$0.1 \leqq \eta^{*}a \leqq 1.0 \quad (1)$$

$$1.1 \leqq \eta^{*}b/\eta^{*}a \leqq 3.5 \quad (2)$$

wherein η*a represents a complex viscosity (Pa·s) determined from a first dynamic viscoelasticity measurement at a measuring frequency of the releasing agent of 6.28 rad/s, η*b represents a complex viscosity (Pa·s) determined from a second dynamic viscoelasticity measurement at a measuring frequency of the releasing agent of 62.8 rad/s, and each of the first and second dynamic viscoelasticities is measured in a temperature range from a temperature that is 15° C. lower than the melting point of the releasing agent to a temperature that is 15° C. higher than the melting point of the releasing agent.

A sixth aspect of the invention provides an image forming apparatus comprising: an image holding member, a unit for uniformly charging a surface of the image holding member; a unit for forming an electrostatic latent image on the surface of the uniformly charged image holding member based on image information; a unit for developing the electrostatic latent image with a developer containing at least a toner to form a toner image; a unit for fusing the toner image on a surface of a recording medium by oilless fusing to form an image on the recording medium; and a unit for transferring the recording medium at a given process speed, wherein the process speed is within a range of about 50 to about 400 mm/s, and the toner contains at least a binder resin, a colorant and a releasing agent, and the releasing agent satisfies the following equations (1) and (2):

$$0.1 \leqq \eta^{*}a \leqq 1.0 \quad (1)$$

$$1.1 \leqq \eta^{*}b/\eta^{*}a \leqq 3.5 \quad (2)$$

wherein η*a represents a complex viscosity (Pa·s) determined from a first dynamic viscoelasticity measurement at a measuring frequency of the releasing agent of 6.28 rad/s, η*b represents a complex viscosity (Pa·s) determined from a second dynamic viscoelasticity measurement at a measuring frequency of the releasing agent of 62.8 rad/s, and each of the first and second dynamic viscoelasticities is measured in a temperature range from a temperature that is 15° C. lower than the melting point of the releasing agent to a temperature that is 15° C. higher than the melting point of the releasing agent.

As described above, the invention can provide a toner for electrostatically charged image development having good removability in oilless fusing and good fusing characteristics such as luster of a fixed image surface and transparency of the image on an OHP sheet, maintaining good luster, suppressing contact traces on the image caused by ejecting rolls at the time that a recording medium having the fixed image is ejected out of an image forming apparatus, providing high-definition images, and having small dependence on an operation environment. The invention can also provide a method for producing such a toner, and an image forming method using the toner for electrostatically charged image development and an image forming apparatus using the image forming method.

BRIEF DESCRIPTION OF THE DRAWING

Preferred embodiments of the invention will be described in detail based on the following figure, wherein.

DETAILED DESCRIPTION OF THE INVENTION

Toner for Electrostatically Charged Image Development

Figure 1:
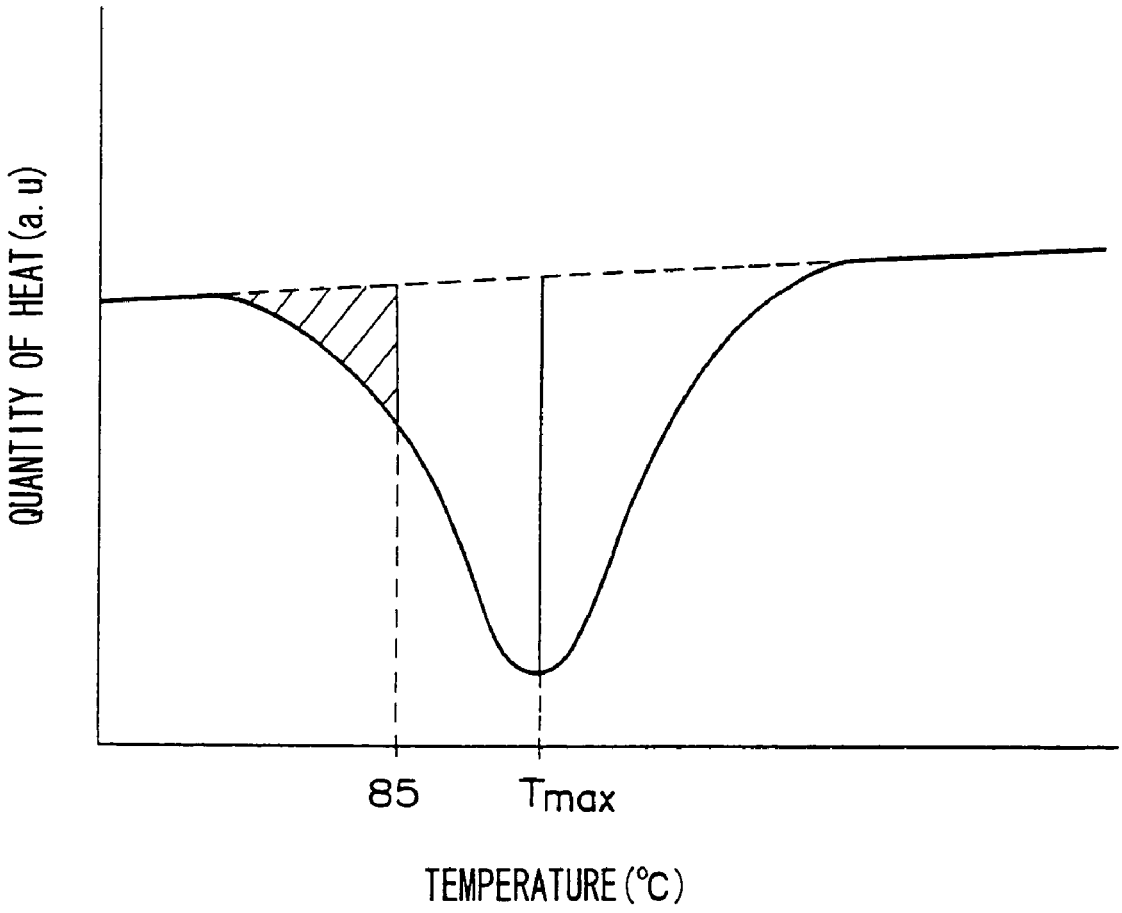
FIG. 1 is a graph describing a method for analyzing a graph obtained by differential thermal analysis of a releasing agent.

The present invention provides a toner for electrostatically charged image development (abbreviated as "toner" hereinafter) containing at least a binder resin, a colorant and a releasing agent. The releasing agent satisfies the following equations (1) and (2):

$$0.1 \leqq \eta^{*}a \leqq 1.0 \quad (1)$$

$$1.1 \leqq \eta^{*}b/\eta^{*}a \leqq 3.5 \quad (2)$$

wherein η*a represents a complex viscosity (Pa·s) determined from a first dynamic viscoelasticity measurement at a measuring frequency of the releasing agent of 6.28 rad/s, η*b represents a complex viscosity (Pa·s) determined from a second dynamic viscoelasticity measurement at a measuring frequency of the releasing agent of 62.8 rad/s, and each of the first and second dynamic viscoelasticities is measured in the temperature range from a temperature that is 15° C. lower than the melting point of the releasing agent to a temperature that is 15° C. higher than the melting point of the releasing agent.

An ARES measuring apparatus manufactured by Rheometric Scientific F.E. Ltd. is used for dynamic viscoelastic measurement of a releasing agent. Usually, a sample of a releasing agent is formed into a tablet. Parallel plates with a diameter of 50 mm and a cup with a diameter of 50 mmϕ are placed above and below a geometry, respectively. Then, a zero point is adjusted, in which a normal force is set at 0. Thereafter, sine-waves in the frequency range of 6.28 to 62.8 rad/s are applied to the sample. At this time, the gap between the parallel plates is adjusted at 1.0 mm, and dynamic viscoelasticities are measured in the temperature range from a temperature that is 15° C. lower than the melting point of the releasing agent to a temperature that is 15° C. higher than the melting point of the releasing agent.

The temperature at which the sample (releasing agent) is measured is controlled with a temperature controller disposed in the measuring apparatus. In order to enhance measuring accuracy, it is preferable that measurement is conducted at a measuring time interval of 30 seconds and a temperature control accuracy after start of the measurement of ±1.0° C. A strain amount is appropriately controlled and maintained at each measuring temperature so that a correct value is obtained by the measurement.

In general, states of a crystalline polymer such as a releasing agent change from a vitreous state through a transition state (melting of crystals) and a rubbery state to a fluid state depending on the motion of molecular chains, as the temperature of the polymer is increased.

In the vitreous state, the temperature of the polymer is not higher than the glass transition temperature (Tg) of the polymer and the motion of the main chain of the polymer is frozen (inactivated). As the temperature of the polymer is gradually raised, the molecular motion activates and the polymer is gradually softened and states of the polymer change from the vitreous state through the transition state (state in which crystals are melting) to the fluid state.

In the vitreous state, the motion of the main chain is frozen, but side chains continue to move. However, the motion of the side chains is also frozen, as the temperature is decreased.

Viscoelastic dispersions called as α-dispersion, β-dispersion and γ-dispersion are observed according to a temperature. The α-dispersion is observed at the highest temperature, called as a principal dispersion and ascribed to extensive thermal motion of polymer main chain segments, and the temperature showing the maximum value of loss tangent is defined as a glass transition temperature. This dispersion results from micro-Brownian movement of the main chain segments that was frozen at a temperature region (vitreous state) lower than the glass transition temperature being activated at the glass transition temperature. The β-dispersion is caused by rotary motion of small segments of linear molecules, or of side chains. The γ-dispersion is caused by smaller molecular motion.

Dynamic viscoelasticity depends on the frequency at the time of dynamic viscoelasticity measurement. When the frequency is high, elasticity tends to be high. In contrast, when the frequency is low, elasticity is low. Dynamic viscoelasticity is also influenced by characteristics such as the structure and the molecular weight of releasing agent molecules.

In an electrophotographic process, the process speed depends on the kind of an apparatus and an image forming mode, as described above. This means that a toner is used under various vibration states. It is important that the bleeding property of a releasing agent from the toner at the time of fixing and the covering property of the releasing agent on the surface of a formed image, which are characteristics necessary for releasing agents, are stable under various vibration states. Accordingly, the characteristics as described above should be evaluated under a dynamic environment, in consideration of differences between various operation environments.

When dynamic elasticity is measured, a vibration state caused by a process speed can be represented by the frequency at the time of dynamic elasticity measurement. Therefore, it is important to define the frequency response characteristic of the releasing agent in consideration of the fact that a frequency depends on the structure and the molecular weight of the releasing agent molecules. When environment in which a toner is used is taken into consideration, it is appropriate to evaluate the frequency response characteristic at two different frequencies of 6.28 rad/s and 6.8 rad/s.

It is commonly known that the frequency response characteristic of a releasing agent remarkably changes in a temperature range close to the melting point of the releasing agent. When the fact that the releasing agent contained in a toner rapidly melts at the time of fusing is taken into consideration, the frequency response characteristic of the releasing agent significantly changes in a temperature range close to the melting point of the releasing agent where temperature range a molten releasing agent and a solid releasing agent coexist.

Theoretically, the melting point of a substance is a temperature where the substance melts. Since the releasing agent used in a toner has a molecular weight distribution, in fact, a solid releasing agent and a molten releasing agent coexist in a temperature range from a temperature that is 15° C. lower than the melting point of the releasing agent to a temperature that is 15° C. higher than the melting point.

Accordingly, dynamic viscoelasticity is measured in the invention in a temperature range from a temperature that is 15° C. lower than the melting point of the releasing agent to a temperature that is 15° C. higher than the melting point. For example, when polyalkylene has a melting point in the temperature range of 75 to 100° C., dynamic viscoelasticity of a polyalkylene releasing agent may be measured at about 85° C. Strictly speaking, dynamic viscoelasticity of the releasing agent is measured at a temperature that is 5° C. lower than the melting point of the releasing agent.

The releasing agent used in the toner of the invention should satisfy the equations (1) and (2) in consideration of the above-described points. The dependency of the frequency under a dynamic environment (specifically, under differences in kinds of apparatuses and image forming modes) is considered in the equation (2). When the equation (2) is satisfied, this means that inherent performance of a releasing agent is not greatly affected by an operation environment and stably exhibited.

The complex viscosity is required to be within the range of about 0.1 to about 1.0 Pa·s as shown by the equation (1). It is preferably within the range of about 0.15 to about 0.8 Pa·s, and more preferably within the range of about 0.15 to about 0.5 Pa·s.

When the complex viscosity $\eta^*a$ is less than 0.1 Pa·s, such a releasing agent bled from the toner at the time of thermal fusing cannot form a uniform coating layer on an image. Moreover, when a recording medium having an image and a coating layer of the releasing agent is heated and pressed by a fusing roller, the roller makes the coating layer uneven (the coating layer may break). Further, when the recording medium is removed from the roller, unevenness occurs. When the complex viscosity exceeds 1.0 Pa·s, the bleeding property of the releasing agent from the toner is bad, which deteriorates removability and fixability.

It is necessary that the ratio ($\eta^*b/\eta^*a$) of the complex viscosities at the two different frequencies be within the range of about 1.1 to about 3.5, as shown by the equation (2). It is preferably within the range of about 1.1 to about 3.3, and more preferably within the range of about 1.1 to about 2.0.

When the ratio $\eta^*b/\eta^*a$ is less than 1.1, the bleeding property of the releasing agent from the toner at the time of fusing is good. However, a releasing agent layer which covers an image may become uneven (impairment of the layer) depending on the operation environment, and the image becomes uneven at the time of removal of a recording medium having the image from a fusing roller in oilless fusing. When the ratio exceeds 3.3, the bleeding property of the releasing agent from the toner is bad depending on the operation environment, causing removal failure. In short, when the ratio is out of the range prescribed by the equation (2), the above-described problems regarding the releasing agent are caused by change of image forming modes and/or image forming apparatuses, and the applicable range of the toner narrows.

The releasing agent used in the toner of the invention will be described in more detail hereinafter. The releasing agent used in the invention is not particularly restricted, so long as it satisfies the equations (1) and (2). However, a mineral or a petroleum wax such as paraffin wax, micro-crystalline wax or Fisher-Tropsh wax, or a modified product thereof such as polyalkylene is particularly preferable.

When polyalkylene is used as the releasing agent, it more preferably satisfies the following thermal properties.

Polyalkylene used in the invention preferably has a major maximum peak, as measured on the basis of ASTM D3418-8, within the range of about 85 to about 95° C. When the major maximum peak appears at a temperature of lower than 85° C., offsetting may easily occur at the time of fusing. When the major maximum peak appears at a temperature higher than 95° C., it is necessary that the fusing temperature be high. Accordingly, the resultant fixed image may not have a smooth surface, deteriorating luster of the image.

When wax other than polyalkylene is used as the releasing agent, the major maximum peak of the wax is preferably within the temperature range from a temperature that is 15° C. lower than the melting point of the releasing agent to a temperature that is 10° C. higher than the melting point.

A DSC-7 (trade name) device manufactured by Perkin-Elmer Co. is used to measure the major maximum peak. The melting points of indium and zinc are used to calibrate the temperature of the detector of the measuring apparatus, and the heat of melting of indium is used to calibrate heat quantity. A sample is placed in an aluminum pan, and an empty pan is used as a reference. The measurement is carried out at a programming rate of 10° C./min.

The temperature at maximum endothermic of the releasing agent which maximum endothermic is obtained by differential thermal analysis of the releasing gent is preferably within the range of about 85 to about 95° C., and more preferably within the range of about 86 to about 93° C. When the temperature is lower than 85° C., the melt viscosity of the releasing agent is low. Although the bleeding property of the releasing agent is good at the time of fusing, the releasing agent melts at the time that a toner is produced by a hetero-aggregation method. Therefore, the amount of the releasing agent inside the toner decreases, making it difficult to control the sizes of obtained particles. Moreover, since the amount of the releasing agent exposed on the surface of the toner increases, which may deteriorate the fluidity of the resultant toner powder.

When the temperature is higher than 95° C., manufacturing stability of the toner is good. However, since the melt viscosity of the releasing agent is high, the bleeding property of the releasing agent in oilless fusing is not good, and therefore removability of the toner from a fusing roll in oilless fusing may deteriorate.

When a releasing agent other than polyalkylene is used, the maxim endothermic thereof preferably appears at a temperature within the temperature range from a temperature that is 15° C. lower than the melting point of the releasing agent to a temperature that is 10° C. higher than the melting point from the viewpoint described above.

The ratio of the sum of endothermic amounts in the temperature range of 85° C. or lower, which sum is obtained on the basis of a partial area calculated from the endothermic curve obtained by differential thermal analysis of the releasing amount, to the sum of endothermic amounts, which is obtained on the basis of the total area calculated from the endothermic curve, is preferably within the range of about 5 to about 15%, more preferably within the range of about 7 to about 13%. The ratio refers to the proportion of the sum of endothermic amounts derived from components having a low melting point in polyalkylene.

When the ratio is less than 5%, compatibility between the releasing agent and a binder resin is so bad that the fixability of the toner may deteriorate. When the ratio exceeds 15%, a binder resin may plasticize and the bleeding property of the releasing agent (polyalkylene) at the time of fusing may deteriorate, which may result in deteriorated removability of the toner from a fusing roll at the time of oilless fusing.

When a releasing agent other than polyalkylene is used, the ratio of the sum of endothermic amounts in the temperature range lower than the melting point of the releasing agent by at least 10° C., which sum is calculated on the basis of a partial area calculated from the endothermic curve obtained by differential thermal analysis of the releasing amount, to the sum of endothermic amounts of the releasing agent, which sum is obtained on the basis of the total area calculated from the endothermic curve, is preferably within the above range from the same viewpoint as above.

The phrases "the sum of endothermic amounts in the temperature range of 85° C. or lower, which sum is obtained on the basis of a partial area calculated from the endothermic curve obtained by differential thermal analysis of a releasing amount (abbreviated as "the sum of endothermic amounts of components having a low melting point" hereinafter)" and "the sum of endothermic amounts of the releasing agent, which sum is obtained on the basis of the total area calculated from the endothermic curve (abbreviated as "the total endothermic amount" hereinafter)" refer to values obtained from a graph obtained by the differential thermal analysis of the releasing agent. How to obtain these values will be described in detail with reference to the drawing.

FIG. 1 is a figure which describes a method for analyzing a graph obtained by differential thermal analysis of a releasing agent.

In FIG. 1, the horizontal axis denotes temperature (° C.), and the vertical axis denotes heat quantity, and directions directing toward and departing from the origin denote endothermic and exothermic, respectively. The solid line curve (endothermic curve) shows endothermic/exothermic change with respect to temperature. The endothermic/exothermic change (endothermic curve) is obtained by differential thermal analysis of a releasing agent. Endothermic starts at a temperature of less than 85° C., and the maximum endothermic (an endothermic peak) appears at a temperature Tmax (° C.) of higher than 85° C. An endothermic amount decreases in the temperature range of higher than Tmax (° C.), and 3endothermic finally ends.

Given that the state not exhibiting neither endothermic nor exothermic (two straight line portions interrupted by the endothermic curve represented by the solid line, and a dotted line as the extensions of the two straight lines in the graph) is a reference, the area surrounded by the curve and the dotted line is defined as the "total endothermic amount", and the area surrounded by the curve, the dotted line and the vertical line exhibiting a temperature of 85° C. (the portion denoted by oblique lines in FIG. 1) is defined as "the sum of endothermic amounts of components having a low melting point".

The amount of polyalkylene in the toner determined by the endothermic peak which is an maximum endothermic amount in differential thermal analysis is preferably about 6 to about 9% by weight, and more preferably about 6.5 to about 8.5% by weight. These ranges apply to the case of a releasing agent other than polyalkylene.

When the amount of the releasing agent is less than 6%, a sufficient amount of the releasing agent to remove a recording medium having a toner image from a fusing roll at the time of oilless fusing does not bleed out of the toner, deteriorating removability. In addition, the surface of the image roughens and therefore luster of the image may be bad. When the amount exceeds 9%, removability is improved but fluidity of the toner powder deteriorates. This is because the amount of the releasing agent on the surface of the toner and on the fixed image increases. Moreover, a discharging roll may cause contact traces on the fixed image at the time of ejecting, deteriorating image quality.

The height of the endothermic peak which is a maximum endothermic refers to the height of the endothermic peak at a temperature of Tmax (the maximum endothermic quantity)

in FIG. 1, and more specifically the height (length) from a point at which the vertical line showing a temperature of Tmax and the endothermic curve intersect with each other to a point at which the vertical line and the dotted line intersect with each other. The amount of polyalkylene in the toner can be readily determined from the height of the endothermic peak and a calibration curve prepared by using a standard sample.

In order to determine the content of a releasing agent in a toner by taking advantage of differential thermal analysis, the toner which is a sample needs to contain the releasing agent. However, a releasing agent alone may be used to evaluate the releasing agent's own thermal characteristics.

The releasing agent used in the invention preferably has the following viscosity characteristic. The viscosity $\eta s140$ of the releasing agent measured at 140° C. with an E-type viscometer having a cone plate with a cone angle of 1.34° C. is preferably within the range of about 1.5 to about 5.0 mPa·s, and more preferably within the range of about 2.5 to about 4.0 mPa·s. When a releasing agent other than polyalkylene is used, it is particularly preferable that the equations (1) and (2) are satisfied and that the viscosity $\eta s140$ of the releasing agent is within the range of about 1.5 to about 5.0 mPa·s.

When the viscosity $\eta s140$ is lower than 1.5 mPa·s, the bleeding property of the releasing agent at the time of fusing is good but the releasing agent layer formed on an image may be uneven. Therefore, the image becomes uneven at the time of removal and luster of the image also becomes uneven. When the viscosity $\eta s140$ is higher than 5.0 mPa·s, the bleeding property is bad and therefore a sufficient amount of the releasing agent to remove a recording medium having an image from a fusing roll is not supplied at the time of oilless fusing and removal failure may occur.

The viscosity $\eta s$ of the releasing agent is measured with an E-type viscometer (manufactured by TOKIMEC Co., Ltd.) having not only a cone plate but also an oil circulating constant temperature bath. The cone plate has a cone angle of 1.34°.

The procedure for measuring the viscosity of the releasing agent is as follows. The temperature of the circulator is adjusted at 140° C., and an empty measuring cup and the cone are attached to the measuring apparatus. Oil is circulated to keep the apparatus at a constant temperature. After the temperature has been stabilized, one gram of a sample is placed in the measuring cup, and the cone which is made stationary is allowed to stand for 5 minutes. After stabilization, the cone is rotated and measurement is conducted. The rotation speed of the cone is 60 rpm. The measurement is conducted three times, and the average of the measured values is defined as $\eta 140$.

It is preferable that the releasing agent dispersed in the toner sequentially bleeds from the toner and is stably supplied onto an image at the time of fusing. When the releasing agent is crystals or a highly crystalline material, the shapes of the releasing agent particles observed under a transmission electron microscope (abbreviated as TEM hereinafter) are both rod-like and massive shapes, and the average diameter of the rod-like shapes (may be called as rod-like crystals) and mass shapes (may be called as massive crystals) is preferably within the range of about 200 to about 1500 nm.

When the releasing agent contains both the rod-like and massive crystals, rod-like releasing agent particles having a large surface area relative to a volume and easily absorbing heat preferentially melt and bleed from the toner and then massive releasing agent particles melt and bleed from the toner at the time that the releasing agent melts in a fusing process. Therefore, the releasing agent sequentially bleed from the toner and is stably supplied onto an image and a recording medium which has the image is stably removed from a fusing roll at the time of oilless fusing.

The average diameter of the rod-like or massive releasing agent particles observed under the transmission electron microscope is preferably within the range of about 200 to about 1,500 nm, and more preferably within the range of about 250 to about 1,000 nm.

When the average particle diameter is less than 200 nm, the releasing agent melts at the time of fusing but may insufficiently bleed and stable removal of a recording medium may not be obtained. When the average particle diameter exceeds 1,500 nm, crystals of the releasing agent with a size of not less than the wavelength of visible light may remain in the image, impairing transparency of transmission images.

The "rod-like shape" refers to a shape having an aspect ratio (major axis length/minor axis length), determined from a releasing agent particle obtained by TEM observation, of not less than 2.0, and the "massive shape" refers to a shape having an aspect ratio of less than 2.0. The "average diameter of the releasing agent particles" refers to the average of the diameters of perfect circles having the same areas as those of the releasing agent particle images obtained by the TEM observation.

The area proportion of the massive crystals observed under the transmission electron microscope (the total area of massive crystals/[the sum of the total area of massive crystals and the total area of rod-like crystals]) is preferably within the range of about 10 to about 30%, and more preferably within the range of about 15 to about 25%.

When the area proportion of the massive crystals is less than 10%, sufficient supply of the releasing agent to an image does not continue at the time of fusing, the image becomes uneven at the time of removal of a recording medium with the image from a fusing roll. When the area proportion exceeds 30%, releasing agent crystals having a size of not smaller than the wavelength of visible light may remain in an image, impairing transparency of the image. Such a phenomenon particularly tends to be evident in a high speed fusing process.

The layer structure of the toner of the invention is not particularly restricted. However, when the toner is produced by an emulsification-polymerization method described later and therefore has a surface-coating layer, the thickness of the coating layer determined by TEM observation is preferably within the range of about 0.1 to about 0.3 μm, and more preferably within the range of about 0.2 to about 0.3 μm. The amount of the releasing agent exposed on the surfaces of the toner particles, as determined by X-ray photoelectron spectroscopy (XPS), is preferably within the range of about 11 to about 30 atm %, and more preferably within the range of about 13 to about 28 atm %.

When the thickness of the coating layer is less than 0.1 μm, the surface of the toner is uneven and the amount of the releasing agent in the coating layer covering the surface of the toner particles is large. Consequently, fluidity of the toner powder is bad and the transferring property of the toner becomes bad and the toner particles aggregate in a development unit and images having defects such as white lines (missing portions) may be formed. When the thickness of the coating layer exceeds 0.3 μm, the coating layer inhibits the releasing agent from bleeding from the toner at the time of oilless fusing, and a recording medium on which an image has been formed may not be able to be removed from a fusing roll in oil fusing.

When the amount of the releasing agent exposed on the surfaces of the toner particles as determined by XPS is less than 11%, removability of a recording medium on which an image has been formed in oilless fusing may be impaired. When the amount exceeds 30%, fluidity of the toner may deteriorate.

The amount of the releasing agent exposed on the surfaces of the toner particles is quantified with an X-ray photoelectron spectrophotometer JPS-9000MX (trade name, manufactured by JEOL Co.). Practically, the amount can be quantified from the following equation (3) and the total amount of detected carbon originating from components other than a releasing agent and the amount of detected carbon originating from the releasing agent.

Amount of releasing agent on surfaces of toner particles=(peak area derived from is orbits of carbon atoms of releasing agent)/(peak area derived from is orbits of carbon atoms on surfaces of toner particles) (3)

When the toner is prepared by using a wet method described later, a dispersion solution in which releasing agent fine particles are dispersed is used.

In such a case, the releasing agent is dispersed in water together with an ionic surfactant, and a polymer electrolyte such as a polymeric acid or a polymeric base and is made fine particles with a homogenizer or a pressure ejection dispersing apparatus that can heat the resultant mixture at a temperature of higher than the melting point of the releasing agent and can apply a high shear force to the mixture. Consequently, the dispersion liquid in which the releasing agent is dispersed in the form of fine particles with an average particle diameter of not more than 1 μis prepared.

The diameters of the releasing agent particles in the dispersion solution may be measured, for example, with a laser diffraction particle size distribution measuring device (trade name LA-700, manufactured by Horiba, Ltd.).

The components other than the releasing agent used in the toner of the invention, which are a binder resin, a colorant and other additives, will be described in detail hereinafter.

Binder Resin

A known resin may be used as the binder resin in the invention. When a toner is prepared from a dispersion liquid containing resin fine particles by a wet method described later, styrenes such as styrene, p-chlorostyrene and α-methylstyrene; esters having a vinyl group such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, auryl methacrylate and 2-ethylhexyl methacrylate; vinylnitriles such as acrylonitrile and methacrylonitrile; vinyl ethers such as vinyl methyl ether and vinyl isobutyl ether; vinyl ketones such as vinyl methyl ketone, vinyl ethyl ketone and vinyl isopropenyl ketone; monomers of polyolefins such as ethylene, propylene and butadiene; and polymers of β-CEA (β-carboxyethyl acrylate) may be used. These resins may be used alone or in combination.

Any of Acrylic esters such as pentanediol diacrylate, hexanediol diacrylate, decanediol diacrylate and nonanediol diacrylate may be used as a cross-linking component.

Other examples of the binder resin include polymers of those monomers, copolymers obtained by a combination of at least two of those monomers and mixtures thereof, non-vinyl condensed resins such as epoxy resins, polyester resins, polyurethane resins, polyamide resins, cellulose resins and polyether resins, mixtures of any of these non-vinyl resins with any of vinyl resins, and graft copolymers obtained by polymerizing a vinyl monomer in the presence of any of the above resins.

When a vinyl monomer is used, a dispersion liquid of vinyl resin fine particles can be prepared by emulsification-polymerization of the vinyl monomer in the presence of an ionic surfactant. When other resins which can be dissolved in an oily solvent having a relatively low solubility in water are used, a dispersion liquid of the resin fine particles can be prepared by dissolving the resin in the solvent, dispersing the resultant resin solution in water together with an ionic surfactant or a polymer electrolyte with a dispersion apparatus such as a homogenizer to form fine particles of the resin, and evaporating the solvent by heating or reducing pressure.

The volume average diameter of the resin fine particles in the dispersion liquid can be measured with a laser diffraction particle diameter distribution measuring device (trade name LA-700, manufactured by Horiba, Ltd.).

-Colorant-

A known colorant may be used as the colorant in the invention. Examples of a black colorant include carbon black, copper oxide, manganese dioxide, aniline black, activated charcoal, non-magnetic ferrite and magnetite.

Examples of a yellow pigment include chrome yellow, zinc yellow, yellow iron oxide, cadmium yellow, chromium yellow, Hansa yellow, Hansa yellow 10G, benzidine yellow G, benzidine yellow GR, threne yellow, quinoline yellow and permanent yellow NCG.

Examples of an orange pigment include red chrome yellow, molybdenum orange, permanent orange GTR, pyrazolone orange, vulcan orange, benzidine orange G, indanthrene brilliant orange RK and indanthrene brilliant orange GK.

Examples of a red pigment include red iron oxide, cadmium red, red lead, mercury sulfide, Watchung red, permanent red 4R, Lithol red, brilliant carmine 3B, brilliant carmine 6B, DuPont oil red, pyrazolone red, rhodamine B lake, lake red C, rose Bengal, eoxin red and alizarin lake.

Examples of a blue pigment include Prussian blue, cobalt blue, alkali blue lake, Victria blue lake, fast sky blue, indanthrene blue BC, aniline blue, ultramarine blue, Calco oil blue, methylene blue chloride, phthalocyanine blue, phthalocyanine green and malachite green oxalate.

Examples of a purple pigment include manganese purple, fast violet B and methyl violet lake.

Examples of a green pigment include chromium oxide, chromium green, pigment green, malachite green lake and final yellow green G.

Examples of a white pigment include zinc white, titanium oxide, antimony white and zinc sulfide.

Examples of an extender include baryte powder, barium carbonate, clay, silica, white carbon, talc and alumina white.

Examples of a dye include basic, acidic, dispersion and direct dyes such as nigrosine, methylene blue, rose Bengal, quinoline yellow and ultramarine blue.

The toner may include at least two colorants, if necessary. The colorant may be selected in consideration of hue angle, chroma, lightness, weather resistance, light permeability on OHP sheets and dispersability in the toner. The addition amount of the colorant in the toner is preferably within the range of about 1 to about 20 parts by weight relative to 100 parts by weight of the binder resin.

However, when a magnetic material is used as the black colorant, the addition amount thereof is different from that of any other colorant, and is preferably within the range of about 30 to about 100 parts by weight relative to 100 parts by weight of the binder resin.

When the toner is produced by a wet method described later, the dispersion solution of the colorant is prepared, and the colorant may be dispersed in a water-based solvent by a known method. For dispersion, a rotary shearing type homogenizer, media dispersion apparatus such as a ball mill, a sand mill or an attritor, or a high pressure counter-collision dispersion apparatus is preferably used. The colorant may be dispersed in the water-based solvent together with a polar surfactant by using a dispersion apparatus such as a homogenizer.

-Other Additives-

The toner may contain a magnetic powder when the toner of the invention is used as a magnetic toner. A substance which can be magnetized in a magnetic field is used as the magnetic powder, and examples thereof include powders of ferromagnetic materials such as iron, cobalt and nickel, and powders of ferrimagnetic materials such as ferrite and magnetite.

When the toner is produced by the wet method described later, in which the toner is formed in an aqueous phase, attention should be paid to mobility and solubility of the magnetic material in an aqueous phase, and susceptibility of the magnetic material to oxidation. Accordingly, it is preferable to previously modify the surface of the magnetic material. For example, the magnetic material is preferably made hydrophobic.

The toner may include a charge control agent in order to improve and stabilize chargability of the toner.

Examples of the charge control agent include conventionally used various charge control agents such as quaternary ammonium salt compounds, nigrosine compounds, dyes including aluminum, iron or chromium complexes, and triphenylmethane dyes.

When the toner is produced by an emulsification-polymerization aggregation method as will be described later, a material hardly soluble in water is preferably used in order to control ionic strength that affects stabilization at the time of aggregation and integration, and reduce the level of pollution caused by waste water.

In a wet method, inorganic fine particles are added to a system from which a toner is to be made in order to stabilize chargability of the toner. Examples of the inorganic fine particles include what is usually used as an external additive on the surfaces of toner particles such as silica, alumina, titania, calcium carbonate, magnesium carbonate and tricalcium phosphate. These are dispersed with an ionic surfactant, a polymeric acid or a polymeric base and used.

These inorganic fine particles my also be used as an internal additive included in a toner, when the toner is produced by an emulsification-polymerization aggregation method as will be described later. In this case, a dispersion liquid may be prepared by dispersing the inorganic fine particles such as colloidal silica in a suitable solvent and used in producing the toner.

Inorganic fine particles such as silica, alumina, titania and/or calcium carbonate, and/or fine particles of a resin such as a vinyl resin, a polyester and a silicone may be added as a fluidizing assistant or cleaning assistant onto the surfaces of toner particles in order to give fluidity to the toner and to improve cleaning property of the toner. The addition may be conducted while the inorganic fine particles and the toner particles are sheared.

-Size and Shape of the Toner-

The sizes and shapes of the toner particles of the invention will be described hereinafter. The volume average particle diameter of the toner particles of the invention is preferably within the range of about 3 to about 9 μm, and more preferably about 3 to about 8 μm. When the particle diameter is less than 2 μm, the toner is insufficiently charged, resulting in a decreased developability of the toner. When the particle diameter exceeds 9 μm, resolution of the resultant image may lessen.

Preferably, the toner has a volume average particle diameter distribution index (GSDv) of at most 13.0, and a ratio of the volume average particle diameter distribution index (GSDv) to a number average particle diameter distribution index (GSDp) of at least 0.95.

When the volume average particle diameter distribution index (GSDv) exceeds 13.0, resolution of the image decreases. When the ratio of the volume average particle diameter distribution index (GSDv) to the number average particle diameter distribution index (GSDP) is less than 0.95, the chargability of the toner may decrease and causes of image defects such as scattering and fogging may arise.

The volume average particle diameter distribution index and volume average particle diameter distribution index can be obtained by using a particle diameter measuring device such as Coulter Counter TA II or MultiSizer II (trade names, manufactured by Beckman-CoulterCo., Ltd.). Specifically, cumulative distribution diagrams are drawn on the basis of measured volume and number average particle diameter distributions (distributions showing the number of particles with respect to each divided particle diameter range (channel)). At this time, cumulation starts at the number of particles having the smallest diameter. When a cumulant has reached 16%, the corresponding particle diameter is defined as the volume average particle diameter D16v or the number average particle diameter D16p. When the cumulant has reached 50%, the corresponding particle diameter is defined as the volume average particle diameter D50v or the number average particle diameter D50p. The volume average particle diameter D84v or number average particle diameter D84p is also defined likewise. The volume average particle diameter distribution index (GSDv) is defined as $(D84v/D16v)^{1/2}$, and the number average particle diameter distribution index (GSDp) is defied as $(D84p/D84v)^{1/2}$.

The toner of the invention preferably has a shape factor SF1 within the range of about 110 to about 140 from the viewpoint of image forming property. The shape factor SF1 is obtained as the average of the shape factors ((square of circumferential length)/(projected area)) of the toner particles, and is actually determined by the following method. Optical microscopic images of toner particles scattered on a slide glass are taken in a Luzex image analyzer through a video camera, and at least 50 toner images are used as samples, and the square of the circumferential length of each sample divided by the projected area of the sample (ML2/A) is calculated. The shape factor SF1 is obtained by averaging the calculated values.

-Charging Characteristics of Toner-

The absolute value of the charge amount of the toner of the invention is preferably within the range of about 20 to about 40 μC/g, and more preferably within the range of about 15 to about 35 μC/g. When the absolute value of the charge amount is less than 20 μC/g, the background tends to be dirty (fog). When the absolute value of the charge amount exceeds 40 μC/g, a decreased image density may be obtained. The ratio of the charge amount of the toner in a summer season (high temperature and high humidity) to that in a winter season (low temperature and low humidity) is preferably within the range of about 0.5 to about 1.5, and more preferably within the range of about 0.7 to about 1.3. When the ratio is out of the range described above, charging property of the toner greatly depends on the environment, and charging becomes unstable, and the toner is not at a practical level. Method for producing toner for electrostatically charged image development The method for producing the toner for electrostatically charged image development of the invention is not particularly restricted, and a known method such as a dry method including a kneading-pulverization method and a wet method including an emulsification-polymerization aggregation method may be employed. The toner of the invention is preferably produced by the latter method, since characteristics necessary for the toner can be compatible at a high level. The method for producing the toner preferably which is an emulsification-polymerization aggregation method preferably involves the following steps.

The method for producing the toner of the invention preferably includes: mixing a dispersion liquid of resin fine particles comprising first resin fine particles having a volume average particle diameter, a dispersion liquid of a colorant, and a dispersion liquid of a releasing agent to prepare a mixed solution; adding a coagulant into the mixed solution to form core aggregates; adhering second resin fine particles on the surface of the core aggregates to form core/shell aggregates; and heating the core/shell aggregates to a temperature not lower than the glass transition temperature of the first and/or second resin fine particles to fuse and integrate the core/shell aggregates.

The adhesion step may be omitted and the core aggregates may be fused, if necessary. The method may further include: washing and drying toner mother particles obtained by the fusion step. The method may also further include adding an external additive on the surfaces of the toner mother particles, if necessary.

A releasing agent such as polyalkylene satisfying the equations (1) and (2) is inevitably used in the dispersion liquid of the releasing agent. The dispersion liquids used in the mixing step may be prepared as described above.

At least a polymer of a metal salt such as polyaluminum chloride may be used as the coagulant.

In the aggregation step or mixing step, a dispersion liquid of inorganic fine particles is preferably added to or used in the mixed solution prepared by mixing the dispersion liquids described above.

Each of the steps mentioned above will be described in detail hereinafter.

The mixed solution including various dispersion liquids such as the dispersion liquid prepared by dispersing the first resin fine particles with an ionic surfactant, and the dispersion liquid prepared by dispersing the colorant with an ionic surfactant having the same polarity as that of the ionic surfactant used in the dispersion liquid of the resin fine particles is prepared in the mixing step.

Then, an inorganic metal salt such as aluminum sulfate or a polymer of an inorganic metal salt such as polyaluminum chloride is added to the mixed solution to cancel (neutralize) ionic unbalance caused by the addition of the dispersants, and the resultant liquid is heated in a temperature range of not higher than the glass transition temperature of the first resin fine particles to form aggregates (core aggregates) by hetero-aggregation. Such an aggregation step may be divided into several steps.

Subsequently, the adhesion step is conducted. The dispersion liquid including second resin fine particles dispersed therein and a dispersant, the polarity and the amount of which are such that an ionic unbalance can be cancelled is added to the resultant liquid in which core aggregates have been formed to adhere the second resin fine particles onto the core aggregates and to form core/shell aggregates. Then, in order to stop growth of the core/shell aggregate particles, an alkali such as NaOH is added into the resultant liquid in which the core/shell aggregates have been formed.

Subsequently, the resultant liquid is heated at a temperature of not higher than the glass transition temperature of the resin of the core aggregates (the resin component of the first resin fine particles) or of the resin component of the second resin fine particles for an extremely short period of time. The liquid is stabilized at a higher temperature, and then is heated to a temperature of not lower than the glass transition temperature of one of these resin components, and the core/shell aggregates are fused and integrated to obtain wet toner mother particles.

When the grass transition temperature of the first resin fine particles is different from that of the second resin fine particles, only the core aggregate portions of the core/shell aggregates or the adhesion layer (shell layer) comprising the second resin fine particles may be selectively fused and integrated by making use of this temperature difference and selecting the heating temperature. The aggregation procedure as described above may be repeated plural times.

The toner of the invention can be obtained through known washing, solid/liquid separation and drying steps after the fusion step.

The solvent remaining in the toner particles is sufficiently replaced and removed with deionized water in the washing step from the viewpoint of chargability of the toner. The solid/liquid separation step is not particularly restricted, however suction filtration or pressurized filtration is preferably employed from the viewpoint of productivity. The drying step is also not particularly restricted, however freeze drying, flash jet drying, fluidized drying or vibration fluidized drying is preferably used from the viewpoint of productivity.

Examples of the surfactant used to stabilize components dispersed in various dispersion liquids in the method for producing the toner include anionic surfactants such as sulfate, sulfonate and phosphate surfactants and soap, and cationic surfactants such as amine salt and quaternary ammonium salt surfactants. It is effective to use a nonionic surfactant such as polyethyleneglycol, alkylphenolethylene oxide adduct surfactants together with any of the anionic and cationic surfactants.

An ordinary dispersing apparatus such as a pressurizing shearing homogenizer including Gaulin homogenizer, or a rotary shearing homogenizer, or a ball mill, a sand mill or a dyno mill using a dispersion medium can be used to prepare various dispersion liquids. Image forming method and Image forming apparatus The image forming method using the toner of the invention will be described hereinafter. The image forming method of the invention can be applied to any image forming method using a known electrophotographic process. However, since the toner of the invention contains the releasing agent as described above, the image forming method of the invention is preferably applied to an image forming method using so-called oilless fusing, in which no oil is externally supplied onto the surface of a fusing member such as a roll or a belt at the time of fusing.

Such image forming method preferably includes: uniformly charging the surface of an image holding member; forming an electrostatic latent image on the surface of the uniformly charged image holding member based on image information; developing the electrostatic latent image with a developer containing at least a toner to obtain a toner image; and fusing the toner image on the surface of a recording medium by oilless fusing to form an image on the recording medium.

The image forming method of the invention is not particularly restricted, so long as the method includes at least the charging step, the electrostatic latent image forming step, the development step and the fusing step. The method may include other steps, for example a transfer step for transferring the toner image formed on the surface of the image holding member onto a transfer member.

An image forming apparatus conducting the image forming method of the invention preferably an image holding member, a unit for uniformly charging the surface of the image holding member; a unit for forming an electrostatic latent image on the surface of the uniformly charged image holding member based on image information; a unit for developing the electrostatic latent image with a developer containing at least a toner to form a toner image; a unit for fusing the toner image on the surface of a recording medium by oilless fusing to form an image on the recording medium; and a unit for transferring the recording medium at a constant process speed.

An image is usually formed at a constant process speed (strictly speaking, the process speed refers to a speed at which the transfer unit, which is, for example, a roll or a belt or the fusing unit conveys a recording medium) with the image forming apparatus described above. However, even when the same apparatuses, each of which has at least two image forming modes such as monochromatic and color modes, are used, setting conditions of the process speed depend on the image forming modes (in other words, an image is formed at the process speed of one selected from the at least two process modes). Even when different kinds of image forming apparatuses have the same image forming mode, the setting conditions may depend on the kind of the image forming apparatus.

Namely, when an image forming apparatus has at least two process speeds, vibration states depend on process speeds. When different kinds of apparatuses have the same process speed and the same process speed is selected in these apparatuses, vibration states in the apparatuses may depend on the structures of the apparatuses.

Examples of commercially available image forming apparatuses include a relatively low speed apparatus operated at a low process speed for personal use and a high speed apparatus operated at a relatively high speed for business use. Therefore, these apparatuses form images at various process speeds (or under different vibration states).

However, since the toner of the invention less depend on operation environments ascribed to different process speeds, the toner of the invention can maintain excellent removability and good luster, has excellent fusing characteristics such as good luster of the surface of a fixed image and transparency on OHP sheets, and suppresses roll contact traces at the time that the fixed image is ejected out of an image forming apparatus. Therefore, the toner of the invention can provide images of high definition in a wide process speed range irrespective of the differences of the kinds of apparatuses and image forming modes.

When an image is formed with the image forming apparatus described above and the toner of the invention, the process speed is preferably in the range of from the upper limit to the lower limit of process speeds in commercially available image forming apparatuses, which range is specifically about 50 to about 400 mm/s. However, the process speed is preferably within the range of about 50 to about 360 mm/s.

EXAMPLES

The invention will be described in detail hereinafter with reference to examples, but the invention is restricted to these examples.

Toners are produced by the following procedure, and various items of the toners are evaluated in Examples and Comparative examples. At first, a dispersion liquid of resin fine particles (including first resin fine particles), a dispersion liquid of a colorant, a dispersion liquid of releasing agent particles and a dispersion liquid of inorganic fine particles are separately prepared in producing toners. Then, prescribed amounts of these dispersion liquids are mixed and stirred, and a polymer of an inorganic metal salt is added to the resultant dispersion to neutralize ionic charges of the dispersion, and aggregates (core aggregates) including the above particles are formed.

Subsequently, another dispersion liquid of resin fine particles (including second resin fine particles) is added to the resultant dispersion in which the core aggregates have been formed. The resin fine particles are adhered onto the surfaces of the core aggregates so that the diameters of the core/shell aggregates become a desired toner particle diameter. Thus, core/shell aggregates are obtained. An inorganic hydroxide is added to the resultant dispersion in which the core/shell aggregates have been formed to change the pH of the dispersion from a weakly acidic value to a neutral value. Thereafter, the aggregates are fused by heating them to a temperature of not lower than the glass transition temperature of the binder resin of the core/shell aggregates. After fusing reaction has finished, the fused particles are washed and dried. A toner is thus obtained. In some cases, the adhesion step is omitted in producing toners.

A method for preparing each material (dispersion liquid) and methods for producing a toner will be described hereinafter, and evaluation methods of the toner and the results thereof will be described later. "Parts by weight" is abbreviated as "parts" hereinafter. Preparation of resin fine particles

| | |
|---|---|
| Oil phase | |
| styrene (manufactured by Wako Pure Chemical Industries, Ltd.): | 30 parts |
| n-butyl acrylate (Wako Pure Chemical Industries, Ltd.): | 10 parts |
| β-carboethyl acrylate (manufactured by Rhodia Nikka Co.): | 1.3 parts |
| dodecanethiol (manufactured by Wako Pure Chemical Industries, Ltd.): | 0.4 parts |
| Aqueous phase 1 | |
| deionized water: | 17.0 parts |
| anionic surfactant (trade name Dow Fax 2A1, manufactured by Dow Chemical Company) | 0.40 parts |
| Aqueous phase 2 | |
| deionized water: | 40 parts |
| anionic surfactant (trade name Dow Fax 2A1, manufactured by Dow Chemical Company): | 0.05 parts |

-continued

| | |
|---|---|
| ammonium persulfate (manufactured by Wako Pure Chemical Industries, Ltd.): | 0.4 parts |

A dispersion liquid of emulsified monomers is prepared by putting the oil phase and aqueous phase 1 into a flask and stirring the resultant. Then, the components in aqueous phase 2 are put into a reaction vessel. While the aqueous phase is stirred and the internal air of the vessel is sufficiently replaced with nitrogen, the phase is heated in an oil bath until the temperature of the phase reaches 75° C. Subsequently, the dispersion liquid of the emulsified monomer is slowly dripped into the reaction vessel over 3 hours and emulsification-polymerization is conducted. The polymerization is continued at 75° C. after completion of the dripping. Three hours later, the polymerization is completed. Thus, a dispersion liquid of resin fine particles is obtained.

The volume average particle diameter D50v of the resin fine particles is 220 nm, as measured with a laser diffraction particle diameter measuring device (trade name LA-700, manufactured by Horiba Ltd.). The glass temperature of the resin is 52° C., as measured with a differential scanning calorimeter (trade name DSC-50, manufactured by Shimadzu Corporation) at a programming rate of 10° C./minuets. The number average molecular weight Mn (as converted into the molecular weight of polystyrene) of the resin is 13.0, as measured with a molecular weight measuring device (trade name HLC-8020, manufactured by Tosoh Corporation) using THF (tetrahydrofuran) as a solvent.

The dispersion liquid of the anionic resin fine particles having a central diameter of 220 nm, a solid content of 42%, a glass transition temperature of 52° C. and a weight average molecular weight of 30,000 is thus obtained.

| Preparation of colorant dispersion liquid | |
|---|---|
| cyan pigment (copper phthalocyanine B15:3, trade name, manufactured by Dainichiseika Color & Chemicals Mfg. Co.,): | 45 parts |
| ionic surfactant (trade name Neogen RK, manufactured by Dai-ichi Kogyo Seiyaku Co., Ltd.): | 5 parts |
| deionized water: | 200 parts |

A dispersion liquid of a colorant with a central diameter of 168 nm is obtained by mixing and dissolving the above components, and by stirring the resultant with a homogenizer (IKA UltraTurrax) for 10 minutes.

Preparation of Dispersion Liquid of Inorganic Fine Particles

Two parts of colloidal silica (trade name ST-OL, manufactured by Nissan Chemical Co.; central diameter: 40 nm) and 5 parts of colloidal silica (trade name ST-OS, manufactured by Nissan Chemical Co.; central diameter: 8 nm) are mixed, and 15 g of a nitric acid solution with a concentration of 0.3 mol/L and 0.3 g of polyaluminum chloride are added to the resultant mixture. The resultant mixture is allowed to stand at an ordinary temperature for 20 minutes and the dispersed fine particles aggregate. A dispersion liquid of inorganic fine particles is thus obtained.

| Preparation of releasing agent dispersion liquid 1 | |
|---|---|
| polyalkylene wax FNP 0092 (trade name, manufactured by Nippon Seiro Co., Ltd.; melting point: 91° C.) | 45 parts |
| cationic surfactant (trade name Neogen RK, manufactured by Dai-ichi Kogyo Seiyaku Co., Ltd.): | 5 parts |
| deionized water: | 200 parts |

The above components are mixed. The resultant mixture is heated at 95° C., thoroughly stirred with Ultra Turrax T50 (manufactured by IKA Japan K.K.), and then stirred with a pressure ejection Gaulin homogenizer to obtain releasing agent dispersion liquid 1 with a central diameter of 220 nm and a solid content of 25%.

The releasing agent has a viscosity ηs140 of 3.5 mPa·s as measured with an E-type viscometer, a complex viscosity η*a at a measuring frequency of 6.28 rad/s at 85° C. of 0.3 Pa·s, and a ratio η*b/η*a of a complex viscosity η*b at a measuring frequency of 62.8 rad/s at 85° C. to the complex viscosity η*a of 1.1. The maximum value of endothermic quantity obtained by differential thermal analysis appears at 91° C., and the ratio of the sum of endothermic amounts in the temperature range of 85° C. or lower, which sum is obtained on the basis of a partial area calculated from an endothermic curve obtained by the differential thermal analysis of the releasing amount, to the sum of endothermic amounts of the releasing agent, which is obtained on the basis of the total area calculated from the endothermic curve, is 11%.

| Preparation of releasing agent dispersion liquid 2 | |
|---|---|
| polyalkylene wax (trade name manufactured by Nippon Seiro Co., Ltd.; product obtained by distilling Sasol H2 molecules; melting point: 85° C.) | 45 parts |
| cationic surfactant (trade name Neogen RK, manufactured by Dai-ichi Kogyo Seiyaku Co., Ltd.): | 5 parts |
| deionized water: | 200 parts |

The above components are mixed. The resultant mixture is heated at 100° C., thoroughly stirred with Ultra Turrax T50 (manufactured by IKA Japan K.K.), and then stirred with a pressure ejection Gaulin homogenizer to obtain releasing agent dispersion liquid 2 with a central diameter of 200 nm and a solid content of 25%.

The releasing agent has a viscosity 1η*s140 of 1.5 mPa·s as measured with an E-type viscometer, a complex viscosity η*a at a measuring frequency of 6.28 rad/s at 85° C. of 0.2 Pa·s, and a ratio η*b/η*a of a complex viscosity η*b at a measuring frequency of 62.8 rad/s at 85° C. to the complex viscosity η*a of 2.2. The maximum value of endothermic quantity obtained by differential thermal analysis appears at 85° C., and the ratio of the sum of endothermic amounts in the temperature range of 85° C. or lower, which sum is obtained on the basis of a partial area calculated from an endothermic curve obtained by the differential thermal analysis of the releasing amount, to the sum of endothermic amounts of the releasing agent, which is obtained on the basis of the total area calculated from the endothermic curve, is 15%.

| Preparation of releasing agent dispersion liquid 3 | |
|---|---|
| polyalkylene wax {trade name manufactured by Nippon Seiro Co., Ltd.; product obtained by distilling FT 100 molecules; melting point: 95° C.): | 45 parts |
| cationic surfactant (trade name Neogen RK, manufactured by Dai-ichi Kogyo Seiyaku Co., Ltd.): | 5 parts |
| deionized water: | 200 parts |

The above components are mixed. The resultant mixture is heated at 110° C., thoroughly stirred with Ultra Turrax T50 (manufactured by IKA Japan K.K.), and then stirred with a pressure ejection Gaulin homogenizer to obtain releasing agent dispersion liquid 3 with a central diameter of 210 nm and a solid content of 25%.

The releasing agent has a viscosity ηs140 of 4.8 mPa·s as measured with an E-type viscometer, a complex viscosity η*a at a measuring frequency of 6.28 rad/s at 85° C. of 0.7 Pa·s, and a ratio η*b/η*a of a complex viscosity η*b at a measuring frequency of 62.8 rad/s at 85° C. to the complex viscosity η*a of 3.5. The maximum value of endothermic quantity obtained by differential thermal analysis appears at 95° C., and the ratio of the sum of endothermic amounts in the temperature range of 85° C. or lower, which sum is obtained on the basis of a partial area calculated from an endothermic curve obtained by the differential thermal analysis of the releasing amount, to the sum of endothermic amounts of the releasing agent, which is obtained on the basis of the total area calculated from the endothermic curve, is 5%.

| Preparation of releasing agent dispersion liquid 4 | |
|---|---|
| polyalkylene NHP7 (trade name, manufactured by Nippon Seiro Co., Ltd.; melting point: 77° C.) | 45 parts |
| cationic surfactant (trade name Neogen RK, manufactured by Dai-ichi Kogyo Seiyaku Co., Ltd.): | 5 parts |
| deionized water: | 200 parts |

The above components are mixed. The resultant mixture is heated at 100° C., thoroughly stirred with Ultra Turrax T50 (manufactured by IKA Japan K.K.), and then stirred with a pressure ejection Gaulin homogenizer to obtain releasing agent dispersion liquid 4 with a central diameter of 190 nm and a solid content of 25%.

The releasing agent has a viscosity ηs140 of 1.2 mPa·s as measured with an E-type viscometer, a complex viscosity η*a at a measuring frequency of 6.28 rad/s at 85° C. of 0.1 Pa s, and a ratio 72 *b/η*a of a complex viscosity η*b at a measuring frequency of 62.8 rad/s at 85° C. to the complex viscosity η*a of 0.9. The maximum value of endothermic quantity obtained by differential thermal analysis appears at 77° C., and the ratio of the sum of endothermic amounts in the temperature range of 85° C. or lower, which sum is obtained on the basis of a partial area calculated from an endothermic curve obtained by the differential thermal analysis of the releasing amount, to the sum of endothermic amounts of the releasing agent, which is obtained on the basis of the total area calculated from the endothermic curve, is 17%.

| Preparation of releasing agent dispersion liquid 5 | |
|---|---|
| polyalkylene FT100 (trade name, manufactured by Nippon Seiro Co., Ltd.; melting point: 98° C.) | 45 parts |
| cationic surfactant (trade name Neogen RK, manufactured by Dai-ichi Kogyo Seiyaku Co., Ltd.): | 5 parts |
| deionized water: | 200 parts |

The above components are mixed. The resultant mixture is heated at 113° C., thoroughly stirred with Ultra Turrax T50 (manufactured by IKA Japan K.K.), and then stirred with a pressure ejection Gaulin homogenizer to obtain releasing agent dispersion liquid 5 with a central diameter of 250 nm and a solid content of 25%.

The releasing agent has a viscosity ηs140 of 6.0 mPa·s as measured with an E-type viscometer, a complex viscosity η*a at a measuring frequency of 6.28 rad/s at 85° C. of 1.1 Pa·s, and a ratio η*b/η*a of a complex viscosity η*b at a measuring frequency of 62.8 rad/s at 85° C. to the complex viscosity η*a of 3.6. The maximum value of endothermic quantity obtained by differential thermal analysis appears at 98° C., and the ratio of the sum of endothermic amounts in the temperature range of 85° C. or lower, which sum is obtained on the basis of a partial area calculated from an endothermic curve obtained by the differential thermal analysis of the releasing amount, to the sum of endothermic amounts of the releasing agent, which is obtained on the basis of the total area calculated from the endothermic curve, is 2.3%.

| Preparation of releasing agent liquid solution 6 | |
|---|---|
| polyalkylene NHP5 (trade name, manufactured by Nippon Seiro Co., Ltd.; melting point: 62° C.) | 45 parts |
| cationic surfactant (trade name Neogen RK, manufactured by Dai-ichi Kogyo Seiyaku Co., Ltd.): | 5 parts |
| deionized water: | 200 parts |

The above components are mixed. The resultant mixture is heated at 100° C., thoroughly stirred with Ultra Turrax T50 (manufactured by IKA Japan K.K.), and then stirred with a pressure ejection Gaulin homogenizer to obtain releasing agent dispersion liquid 6 with a central diameter of 180 nm and a solid content of 25%.

The releasing agent has a viscosity ηs140 of 0.5 mPa·s as measured with an E-type viscometer, a complex viscosity η*a at a measuring frequency of 6.28 rad/s at 85° C. of 0.5 Pa·s, and a ratio η*b/η*a of a complex viscosity η*b at a measuring frequency of 62.8 rad/s at 85° C. to the complex viscosity η*a of 1.1. The maximum value of endothermic quantity obtained by differential thermal analysis appears at 62° C., and the ratio of the sum of endothermic amounts in the temperature range of 85° C. or lower, which sum is obtained on the basis of a partial area calculated from an endothermic curve obtained by the differential thermal analysis of the releasing amount, to the sum of endothermic amounts of the releasing agent, which is obtained on the basis of the total area calculated from the endothermic curve, is 40.9%.

| Production of toner 1 | |
|---|---|
| dispersion liquid of resin fine particles | 193.8 parts |
| dispersion liquid of colorant | 14 parts |
| dispersion liquid of inorganic fine particles | 9.5 parts |
| releasing agent dispersion liquid 1 | 30.6 parts |
| polyaluminum chloride | 0.6 parts |

The above components are mixed and thoroughly stirred in a stainless round-bottom flask with Ultra Turrax T50. 1.2 parts of polyaluminum chloride is added to the resultant dispersion, and the resultant is stirred with Ultra Turrax. Subsequently, while the dispersion is stirred, the dispersion in the flask is hated to 48° C. in a heating oil bath to form core aggregates. After keeping the dispersion at 48° C. for 60 minutes, 36 parts of the dispersion liquid of the resin fine particles is gently added to the dispersion.

The pH of the resultant dispersion in the flask is adjusted to 6.0 by adding an aqueous sodium hydroxide solution with a concentration of 0.5 mol/L into the dispersion, and the stainless flask is sealed. The temperature of the resultant dispersion is raised to 96° C. and that temperature is kept for 3.5 hours while the dispersion is stirred with a magnetic seal.

After completion of the reaction, the dispersion is cooled and filtered and the resultant is sufficiently washed with deionized water and suction-filtered with a Nutche filter to separate solid from liquid. The solid is re-dispersed in 3 L of deionized water at 40° C., and stirred at 300 rpm and washed for 15 minutes.

This process is repeated five more times. When the pH, electrical conductivity and surface tension of the filtrate have reached 7.01, 9.7 μS/cm and 71.2 Nm, respectively, the dispersion is suction-filtered with a Nutche filter and No. 5 filter paper to separate solid from liquid. The solid is dried in vacuum for 12 hours and toner 1 is thus obtained.

Toner 1 has a volume average particle diameter D50v of 5.7 μm and a volume average particle diameter index GSDv of 1.20, as measured with a Coulter counter. The toner particles observed under a Luzex image analyzer have a potato-like shape with a shape factor SF1 of 132.0.

An observation of toner 1 under a transmission electron microscope shows that the releasing agent present in the toner is rod-like particles and massive particles, and the area proportion of the massive particles is 20%. The average diameter of the releasing agent particles is 220 nm. It has been confirmed that the toner particles have a shell layer. The thickness of the shell layer is 0.3 μm.

The amount of the releasing agent on the surfaces of toner 1 measured with an X-ray photoelectron spectroscopy is 11 atm %.

Production of Tone 2

Toner 2 is obtained in the same manner as the method of producing toner 1, except that 126.8 parts of the dispersion liquid of the resin fine particles and 30.6 parts of dispersion liquid 2 of the releasing agent are used in forming core aggregates, and 21 parts of the dispersion liquid of the resin fine particles is added in the adhesion step.

Toner 2 has a volume average particle diameter D50v of 5.6 μm and a volume average particle diameter index GSDv of 1.21, as measured with a Coulter counter. The toner particles observed under a Luzex image analyzer have a potato-like shape with a shape factor SF1 of 133.4.

An observation of toner 2 under a transmission electron microscope shows that the releasing agent present in the toner is rod-like particles and massive particles, and the area proportion of the massive particles is 24%. The average diameter of the releasing agent particles is 200 nm. It has been confirmed that the toner has a shell layer. The thickness of the shell layer is 0.2 μm.

The amount of the releasing agent on the surface of toner 2 measured with an X-ray photoelectron spectroscopy is 23 atm %.

Production of Toner 3

Toner 3 is obtained in the same manner as the method of producing toner 1, except that 98.1 parts of the dispersion liquid of the resin fine particles and 22.6 parts of dispersion liquid 3 of the releasing agent are used in forming core aggregates.

Toner 3 has a volume average particle diameter D50v of 5.4 μm and a volume average particle diameter index GSDv of 1.21, as measured with a Coulter counter. The toner particles observed under a Luzex image analyzer have a potato-like shape with a shape factor SF1 of 133.1.

An observation of toner 3 under a transmission electron microscope shows that the releasing agent present in the toner is rod-like particles and massive particles, and the area proportion of the massive particles is 28%. The average diameter of the releasing agent particles is 210 nm. It has been confirmed that the toner has a shell layer. The thickness of the shell layer is 0.3 μm.

The amount of the releasing agent on the surface of toner 3 measured with an X-ray photoelectron spectroscopy is 12 atm %.

Production of Toner 4

Toner 4 is obtained in the same manner as the method of producing toner 1, except that 104.1 parts of the dispersion liquid of the resin fine particles and 22.1 parts of dispersion liquid 4 of the releasing agent are used in forming core aggregates, and 95.7 parts of the dispersion liquid of the resin fine particles is added in the adhesion step.

Toner 4 has a volume average particle diameter D50v of 5.8 μm and a volume average particle diameter index GSDv of 1.20, as measured with a Coulter counter. The toner particles observed under a Luzex image analyzer have a potato-like shape with a shape factor SF1 of 130.8.

An observation of toner 4 under a transmission electron microscope shows that the releasing agent present in the toner is rod-like particles and massive particles, and the area proportion of the massive particles is 29%. The average diameter of the releasing agent particles is 190 nm. It has been confirmed that the toner has a shell layer. The thickness of the shell layer is 0.3 μm.

The amount of the releasing agent on the surface of toner 4 measured with an X-ray photoelectron spectroscopy is 10 atm %.

Production of Toner 5

Toner 5 is obtained in the same method as the method of producing toner 1, except that 198.6 parts of the dispersion liquid of the resin fine particles and 23.8 parts of dispersion liquid 5 of the releasing agent are used in forming core aggregates, and an adhesion step is not conducted.

Toner 5 has a volume average particle diameter D50v of 5.4 μm and a volume average particle diameter index GSDv of 1.24, as measured with a Coulter counter. The toner particles observed under a Luzex image analyzer have a potato-like shape with a shape factor SF1 of 134.3.

An observation of toner 5 under a transmission electron microscope shows that the releasing agent present in the toner is rod-like particles and massive particles, and the area proportion of the massive particles is 28%. The average diameter of the releasing agent particles is 240 nm, and the toner has no shell layer (coating layer).

The amount of the releasing agent on the surface of toner 5 measured with an X-ray photoelectron spectroscopy is 33 atm %.

Production of Toner 6

Toner 6 is obtained in the same method as the method of producing toner 1, except that 98.1 parts of the dispersion liquid of the resin fine particles and 30.6 parts of dispersion liquid 5 of the releasing agent are used in forming core aggregates, and 43.06 parts of the dispersion liquid of the resin fine particles is added in the adhesion step.

Toner 6 obtained has a volume average particle diameter D50v of 5.4 μand a volume average particle diameter index GSDv of 1.25, as measured with a Coulter counter. The toner particles observed under a Luzex image analyzer have a potato-like shape with a shape factor SF1 of 133.3.

An observation of toner 6 under a transmission electron microscope shows that the releasing agent present in the toner is rod-like particles and massive particles, and the area proportion of the massive particles is 8%. The average diameter of the releasing agent particles is 250 nm. It has been confirmed that the toner has a shell layer. The thickness of the shell layer (coating layer) is 0.45 μm.

The amount of the releasing agent on the surface of toner 6 measured with an X-ray photoelectron spectroscopy is 8 atm %.

Production of Toner 7

Toner 7 is obtained in the same method as the method of producing toner 1, except that 155.5 parts of the dispersion liquid of the resin fine particles and 23.8 parts of dispersion liquid 6 of the releasing agent are used in forming the core aggregate, and 43.06 parts of the dispersion liquid of the resin fine particles is added in the adhesion step.

Toner 7 obtained has a volume average particle diameter D50v of 5.7 μand a volume average particle diameter index GSDv of 1.25, as measured with a Coulter counter. The toner particles observed under a Luzex image analyzer have a potato-like shape with a shape factor SF1 of 130.4.

An observation of toner 7 under a transmission electron microscope shows that the releasing agent present in the toner is rod-like particles and massive particles, and the area proportion of the massive particles is 56%. The average diameter of the releasing agent particles is 180 nm. It has been confirmed that the toner has a shell layer. The thickness of the shell layer (coating layer) is 0.15 μm.

The amount of the releasing agent on the surface of toner 7 measured with an X-ray photoelectron spectroscopy is 8 atm %. Addition of external additives onto surfaces of toner and production of developer.

2.5 g of hydrophobic silica (trade name TS720, manufactured by Cabot Corporation) is blended with 50 g of each of the toners thus produced by using a sample mill. The toner onto the surfaces of which hydrophobic silica is adhered is weighed so that the toner concentration is 5% by weight relative to a ferrite carrier coated with 1% by weight of methacrylate (manufactured by Soken Chemical & Engineering Co., Ltd.) and having an average particle diameter of 50 μm. The carrier and the weighted amount of the toner is mixed and stirred for 5 minuets with a ball mill to prepare a developer.

Example 1

Unfused images are formed on recording paper sheets (trade name Paper Sheet J, manufactured by Fuji Xerox Co., Ltd.) and an OHP sheets (trade name Xerofilm V516, manufactured by Fuji Xerox Co., Ltd.) by using a developer including toner 1 and an image forming apparatus (prototype of a DCC400 device (trade name, manufactured by Fuji Xerox Co., Ltd.) which supplies a toner to a latent image in an amount of 13.0 g/m$^2$). Then, the unfused images on the recording paper sheet and OHP sheet are fixed by oilless fusing with an external fusing apparatus having a pair of rolls (nip width of the rolls is 6.5 mm at the press-contact portions of the rolls) at a fusing temperature of 180° C., and at fusing speeds of 180 mm/sec and 360 mm/sec. These fusing speeds selected at the time of oilless fusing correspond to the upper and lower limits of commercially available apparatuses.

It has been confirmed that removability of the recording paper sheet on which an image has been fixed at a fusing speed of 180 mm/sec is good and that the recording paper is removed from the rolls without any resistance. Offsetting does not occur. After the fixed image has been folded in two and expanded, impairment of the image is not observed. Surface luster of the fused image is also good. Removability of the OHP sheet on which an image has been fused at a fusing speed of 180 mm/sec and transparency of the image on the OHP sheet are also excellent and the image has no turbidity. Moreover, it has found that no contact trace of ejecting rolls exists on the surface of the image formed on the OHP sheet.

When another recording paper and OHP sheet on the surface of each of which an image has been fixed at a fusing speed of 360 mm/sec are checked, good results similar to those of the recording paper and OHP sheet on the surface of each of which the image has been fixed at the fusing speed of 180 mm/sec are also obtained in removability, prevention of offsetting, impairment of the image after folding the paper, luster of the image, transparency of the image on the OHP sheet and contact trace on the image formed on the OHP sheet. The results show that the characteristics of the toner of the invention do not depend on fusing speeds (vibration states at the time of operation).

Example 2

A toner image is fixed by oilless fusing in the same manner as in Example 1, except that a developer including toner 2 is used.

It has been confirmed that removability of the recording paper sheet on which an image has been fixed at a fusing speed of 180 mm/sec is good and that the recording paper is removed from the rolls without any resistance. Offsetting does not occur. After the fixed image has been folded in two and expanded, impairment of the image is not observed. Surface luster of the fixed image is also good. Removability of the OHP sheet on which an image has been fixed at a fusing speed of 180 mm/sec and transparency of the image on the OHP sheet are also excellent and the image has no turbidity. Moreover, it has found that no contact trace of ejecting rolls exists on the surface of the image formed on the OHP sheet.

When another recording paper and OHP sheet on the surface of each of which an image has been fixed at a fusing speed of 360 mm/sec are checked, good results similar to those of the recording paper and OHP sheet on the surface of each of which the image has been fixed at the fusing speed of 180 mm/sec are also obtained in removability, prevention of offsetting, impairment of the image after folding the paper, luster of the image, transparency of the image formed on the OHP sheet and contact trace on the image formed on the OHP sheet. The results show that the characteristics of the toner of the invention do not depend on fusing speeds (vibration states at the time of operation).

Example 3

A toner image is fixed by oilless fusing in the same manner as in Example 1, except that a developer including toner 3 is used.

It has been confirmed that removability of the recording paper sheet on which an image has been fixed at a fusing speed of 180 mm/sec is good and that the recording paper is removed from the rolls without any resistance. Offsetting does not occur. After the fixed image has been folded in two and expanded, impairment of the image is not observed. Surface luster of the fixed image is also good. Removability of the OHP sheet on which an image has been fixed at a fusing speed of 180 mm/sec and transparency of the image on the OHP sheet are also excellent and the image has no turbidity. Moreover, it has found that no contact trace of ejecting rolls exists on the surface of the image formed on the OHP sheet.

When another recording paper and OHP sheet on the surface of each of which an image has been fixed at a fusing speed of 360 mm/sec are checked, good results similar to those of the recording paper and OHP sheet on the surface of each of which the image has been fixed at the fusing speed of 180 mm/sec are also obtained in removability, prevention of offsetting, impairment of the image after folding the paper, luster of the image, transparency of the image formed on the OHP sheet and contact trace on the image formed on the OHP sheet. The results show that the characteristics of the toner of the invention do not depend on fusing speeds (vibration states at the time of operation).

Example 4

A toner image is fixed by oilless fusing in the same manner as in Example 1, except that a developer including toner 4 is used.

It has been confirmed that removability of the recording paper sheet on which an image has been fixed at a fusing speed of 180 mm/sec is good and that the recording paper is removed from the rolls without any resistance. Offsetting does not occur. After the fixed image has been folded in two and expanded, impairment of the image is not observed. Surface luster of the fixed image is also good. Removability of the OHP sheet on which an image has been fixed at a fusing speed of 180 mm/sec and transparency of the image on the OHP sheet are also excellent and the image has no turbidity. Moreover, it has found that no contact trace of ejecting rolls exists on the surface of the image formed on the OHP sheet.

When another recording paper and OHP sheet on the surfaces of which an image has been fixed at a fusing speed of 360 mm/sec are checked, good results similar to those of the recording paper and OHP sheet on the surfaces of which the image has been fixed at the fusing speed of 180 mm/sec are also obtained in removability, prevention of offsetting, impairment of the image after folding the paper, luster of the image, transparency of the image formed on the OHP sheet and contact trace on the image formed on the OHP sheet. The results show that the characteristics of the toner of the invention do not depend on fusing speeds (vibration states at the time of operation).

Comparative Example 1

A toner image is fixed by oilless fusing in the same manner as in Example 1, except that a developer including toner 5 is used.

It has been confirmed that removability of the recording paper sheet on which an image has been fixed at a fusing speed of 180 mm/sec is good and that the recording paper is removed from the rolls without any resistance. Offsetting does not occur. However, after the fixed image has been folded in two and expanded, impairment of the image is observed. Luster of the surface of the fixed image is not good and the image has turbidity. Transparency of the OHP sheet on which an image has been fixed at a fusing speed of 180 mm/sec is not good and the image has turbidity. Moreover, it has found that contact traces of ejecting rolls exist on the surface of the image formed on the OHP sheet.

When another recording paper and OHP sheet on the surface of each of which an image has been fixed at a fusing speed of 360 mm/sec are checked, inferior results similar to those of the recording paper and OHP sheet on the surface of each of which the image has been fixed at the fusing speed of 180 mm/sec are obtained in removability, prevention of offsetting, impairment of the image after folding the paper, luster of the image, transparency of the image formed on the OHP sheet and contact trace on the image formed on the OHP sheet.

Comparative Example 2

A toner image is fixed by oilless fusing in the same manner as in Example 1, except that a developer including toner 6 is used.

Removability of the recording paper sheet on which an image has been fixed at a fusing speed of 180 mm/sec is bad and the recording paper adheres to the rolls. An image having uneven luster is obtained. Moreover, after the fixed image has been folded in two and expanded, impairment of the image is observed. Luster of the surface of the fixed image is not good and turbidity of the image surface is found. Transparency of an image fixed on the OHP sheet at a fusing speed of 180 mm/sec is not good and turbidity of the image surface caused by the surface roughness is found. However, it has found that no contact trace of ejecting rolls exists on the surface of the image formed on the OHP sheet.

When another recording paper and OHP sheet on the surface of each of which an image has been fixed at a fusing speed of 360 mm/sec are checked, inferior results similar to those of the recording paper and OHP sheet on the surfaces of which the image has been fixed at the fusing speed of 180 mm/sec are obtained in removability, prevention of offsetting, impairment of the image after folding the paper, luster of the image, transparency of the image formed on the OHP sheet and contact trace on the image formed on the OHP sheet.

Comparative Example 3

A toner image is fixed by oilless fusing in the same manner as in Example 1, except that a developer including toner 7 is used.

Removability of the recording paper sheet on which an image has been fixed at a fusing speed of 180 mm/sec is bad and the recording paper adheres to the rolls. An image having uneven luster is obtained. Moreover, after the fixed image has been folded in two and expanded, impairment of the image is observed. Luster of the surface of the fixed image is not good and turbidity of the image surface is found. Transparency of the image fixed on the OHP sheet at a fusing speed of 180 mm/sec is not good and turbidity of the image surface caused by the surface roughness is found. However, it has found that no contact trace of ejecting rolls exists on the surface of the image formed on the OHP sheet.

When another recording paper and OHP sheet on the surface of each of which an image has been fixed at a fusing speed of 360 mm/sec are checked, inferior results similar to those of the recording paper and OHP sheet on the surface of each of which the image has been fixed at the fusing speed of 180 mm/sec are obtained in removability, prevention of offsetting, impairment of the image after folding the paper, luster of the image, transparency of the image formed on the OHP sheet and contact trace on the image formed on the OHP sheet.

Evaluation of the Results

Table 1 shows the properties of the dispersion liquid of the releasing agent used in producing the toners of Examples and Comparative Examples which have been evaluated. Table 2 shows the properties of the toners of Examples and Comparative Examples which have been evaluated. Table 3 shows the results of evaluations of removability, prevention offsetting, impairment of the images after folding the paper, luster of the image, transparency of the image formed on the OHP sheet, and contact traces on the image formed on the OHP sheets which contact traces are caused by ejecting rolls.

TABLE 1

| Releasing Agent Dispersion Liquid | Releasing Agent | Melting Point (° C.) | Results of Dynamic Viscoelasticity Measurement at 85° C. η * a (Pa · s) | η * b/η * a | Results of Differential Thermal Analysis Max. of Endothermic Amount (° C.) | *1 (%) | ηs140 (mPa · s) |
|---|---|---|---|---|---|---|---|
| Liquid 1 | Polyalkylene wax FNP0092 | 91 | 0.3 | 1.1 | 91 | 11 | 3.5 |
| Liquid 2 | Polyalkylene wax obtained by distilling Sasol H2 molecules | 85 | 0.2 | 2.2 | 85 | 15 | 1.5 |
| liquid 3 | Polyalkylene wax obtained by distilling FT100 molecules | 95 | 0.7 | 3.5 | 95 | 5 | 4.8 |
| Liquid 4 | Polyalkylene wax HNP7 | 77 | 0.1 | 0.9 | 77 | 17 | 1.2 |
| Liquid 5 | Polyalkylene wax FT100 | 98 | 1.1 | 3.6 | 98 | 2.3 | 6 |
| Liquid 6 | Polyalkylene wax HNP5 | 62 | 0.5 | 1.1 | 62 | 40.9 | 0.5 |

*1 Ratio of sum of endothermic amounts in temperature range of not lower than 85° C. to sum of endothermic amounts which is obtained on the basis of total area calculated from endothermic curve

TABLE 2

| Toner | Releasing Agent Dispersion Liquid Used in Production of Toner | Average Diameter of Releasing Agent Particles (nm) | Ratio of Massive Releasing Agent Particles (%) | Thickness of Shell Layer (μm) | Amount of Releasing Agent on Toner Surface (atm %) |
|---|---|---|---|---|---|
| Toner 1 | Dispersion Liquid 1 | 220 | 20 | 0.3 | 11 |
| Toner 2 | Dispersion Liquid 2 | 200 | 24 | 0.2 | 23 |
| Toner 3 | Dispersion Liquid 3 | 210 | 28 | 0.3 | 12 |
| Toner 4 | Dispersion Liquid 4 | 190 | 29 | 0.3 | 10 |
| Toner 5 | Dispersion Liquid 5 | 250 | 28 | None | 33 |
| Toner 6 | Dispersion Liquid 6 | 250 | 8 | 0.45 | 8 |
| Toner 7 | Dispersion Liquid 7 | 180 | 56 | 0.1 | 8 |

TABLE 3

| | | Fusing Speed = 180 mm/s | | | | | | Fusing Speed = 360 mm/s | | | | | |
|---|---|---|---|---|---|---|---|---|---|---|---|---|---|
| | Toner used | Removability | Offset | Impairment of Image after Folding Recording Medium | Luster | Transparency of OHP Sheet | Contact Trace | Removability | Offset | Impairment of Image after Folding Recording Medium | Luster | Transparency of OHP Sheet | Contact Trace |
| Example 1 | Toner 1 | ○ | ○ | ○ | ○ | ○ | ○ | ○ | ○ | ○ | ○ | ○ | ○ |
| Example 2 | Toner 2 | ○ | ○ | ○ | ○ | ○ | ○ | ○ | ○ | ○ | ○ | ○ | ○ |
| Example 3 | Toner | ○ | ○ | ○ | ○ | ○ | ○ | ○ | ○ | ○ | ○ | ○ | ○ |

TABLE 3-continued

| | | Fusing Speed = 180 mm/s | | | | | | Fusing Speed = 360 mm/s | | | | | |
|---|---|---|---|---|---|---|---|---|---|---|---|---|---|
| | Toner used | Removability | Offset | Impairment of Image after Folding Recording Medium | Luster | Transparency of OHP Sheet | Contact Trace | Removability | Offset | Impairment of Image after Folding Recording Medium | Luster | Transparency of OHP Sheet | Contact Trace |
| Example 4 | 3 Toner 4 | ○ | ○ | ○ | ○ | ○ | ○ | ○ | ○ | ○ | ○ | ○ | ○ |
| Comparative Example 1 | Toner 5 | ○ | ○ | X | X | X | X | ○ | ○ | X | X | X | X |
| Comparative Example 2 | Toner 6 | X | X | X | X | X | ○ | X | X | X | X | X | ○ |
| Comparative Example 3 | Toner 7 | X | X | X | X | X | ○ | X | X | X | X | X | ○ |

Methods for evaluating characteristics of images fixed by oilless fusing and recording media having images and evaluation criteria.

Methods for evaluating characteristics of images fixed by oilless fusing and recording media having the images and evaluation criteria are as follows.

-Removability-

Removability is evaluated by checking with naked eye removability of the recording paper or the OHP sheet from the rolls and whether defective luster is obtained. The evaluation criteria of removability shown in Table 3 are as follows.

○: The recording medium is smoothly removed from the rolls and luster without defects is obtained.

Δ: The recording medium is spontaneously removed but slightly uneven luster is obtained.

X: The recording medium is not spontaneously removed, or remarkably uneven luster is obtained.

-Offsetting-

Offsetting is evaluated by conducting fusing, causing a blank paper sheet to pass through the fusing apparatus, and checking with naked eyes whether a toner which remains on the fusing rolls after fusing is transferred to the blank paper sheet. The evaluation criteria of offsetting shown in Table 3 are as follows.

○: Offsetting does not occur.

Δ: Offsetting does not occur but the surface of the image is slightly roughened.

X: Offsetting transfer is at a remarkable level.

-Impairment of Image After Folding Paper-

A recording paper on which a fixed image is formed is folded in two and the folded paper is evenly rubbed once by fingers. After the folded paper is expanded, the folded portion is brushed. Then, a visual check is made to determine whether the image has been impaired. The evaluation criteria of impairment of image after folding the paper shown in Table 3 are as follows.

○: The image has not been impaired at all.

Δ: The image has been slightly impaired.

X: The image has been impaired.

-Luster of Image-

Luster of an image surface is observed by naked eyes and evaluated in accordance with the following criteria.

○: Good luster is observed.

Δ: A little bad but uniform luster is observed.

X: Uneven luster, or remarkably bad luster is observed.

-Transparency of Image on OHP Sheet-

Transparency of an image on an OHP sheet is evaluated by projecting, on a screen, the image formed on the OHP sheet and checking, with naked eyes, turbidity of the resultant projected image. The evaluation criteria of transparency of an image on an OHP sheet shown in Table 3 are as follows.

○: The projected image has a sense of clarity.

Δ: The projected image is slightly dark but the difference between the obtained hue and a desired hue is small.

X: Remarkably turbid or dark projected image is observed.

-Contact Trace on Image Formed on OHP Sheet Which Contact Trace is Caused by Ejecting Rolls- The contact trace on an image formed on an OHP sheet which contact trace is caused by ejecting rolls is evaluated by making a visual check and determining whether linear uneven luster exists on an image. The evaluation criteria of the contact trace on an image formed on an OHP sheet which contact trace is caused by ejecting rolls shown in Table 3 are as follows.

○: No trace is found.

Δ: Faint traces are found.

X: Clear traces are found.

What is claimed is:

1. A toner for electrostatically charged image development comprising at least a binder resin, a colorant and a releasing agent, wherein the releasing agent satisfies the following equations (1) and (2):

$$0.1 \leqq \eta^{*}a \leqq 1.0 \quad (1)$$

$$1.1 \leqq \eta^{*}b/\eta^{*}a \leqq 3.5 \quad (2)$$

wherein

η*a represents a complex viscosity (Pa·s) determined from a first dynamic viscoelasticity measurement at a measuring frequency of the releasing agent of 6.28 rad/s, η*b represents a complex viscosity (Pa·s) determined from a second dynamic viscoelasticity measurement at a measuring frequency of the releasing agent of 62.8 rad/s, each of the first and second dynamic viscoelasticities is measured in a temperature range from a temperature that is 15° C. lower than the melting point of the releasing agent to a temperature that is 15° C. higher than the melting point of the releasing agent; and the shapes of releasing agent particles observed under a transmission electron microscope comprise both rod-like and massive shapes, and the average diameter of the rod-like shapes and the massive shapes is within a range of about 200 to about 1500 nm.

2. The toner for electrostatically charged image development of claim 1, wherein the releasing agent contains polyalkylene.

3. The toner for electrostatically charged image development of claim 2, wherein each of the first and second dynamic viscoelasticities is measured at 85° C.

4. The toner for electrostatically charged image development of claim 2, wherein a maximum endothermic determined by differential thermal analysis of the polyalkylene is within a range of 85 to 95° C., a ratio of a sum of endothermic amounts in a temperature range of not higher than 85° C., which sum is calculated from a partial area obtained from an endothermic curve determined by the differential thermal analysis of the polyalkylene, to a sum of endothermic amounts, which is calculated from a total area obtained from the endothermic curve, is within a range of about 5 to about 15%, and the content of the polyalkylene determined based on a maximum endothermic intensity is within a range of about 6 to about 9% by weight.

5. The toner for electrostatically charged image development of claim 1, wherein the releasing agent has a viscosity ηs140 at 140° C., determined using an E-type viscometer comprising a cone plate with a cone angle of 1.34°, in a range of about 1.5 to about 5.0 mPa·s.

6. The toner for electrostatically charged image development of claim 1, wherein an area proportion of the releasing agent having the massive shape observed under a transmission electron microscope is in a range of about 10 to about 30%.

7. The toner for electrostatically charged image development of claim 1, wherein the toner has a coating layer on a surface thereof, and the thickness of the coating layer determined by a transmission electron microscope is within a range of about 0.1 to about 0.3 μm, and the quantity of the releasing agent on the surface of the toner for electrostatically charged image development determined by X-ray photoelectron spectroscopy is within a range of about 11 to about 30 atm %.

8. A method for producing a toner for electrostatically charged image development, the method comprising:

mixing a dispersion liquid of resin fine particles comprising first resin fine particles having a volume average particle diameter of not more than 1 μm, a dispersion liquid of a colorant, and a dispersion liquid of a releasing agent to prepare a mixed solution; adding a coagulant into the mixed solution to form core aggregates;

adhering second resin fine particles on the surface of the core aggregates to form core/shell aggregates; and heating the core/shell aggregates to a temperature not lower than the glass transition temperature of the first and/or second resin fine particles to fuse and integrate the core/shell aggregates, wherein the releasing agent satisfies the following equations (1) and (2):

$$0.1 \leqq \eta^*a \leqq 1.0 \quad (1)$$

$$1.1 \leqq \eta^*b/\eta^*a \leqq 3.5 \quad (2)$$

wherein

η*a represents a complex viscosity (Pa·s) determined from a first dynamic viscoelasticity measurement at a measuring frequency of the releasing agent of 6.28 rad/s, η*b represents a complex viscosity (Pa·s) determined from a second dynamic viscoelasticity measurement at a measuring frequency of the releasing agent of 62.8 rad/s, each of the first and second dynamic viscoelasticities is measured in a temperature range from a temperature that is 15° C. lower than the melting point of the releasing agent to a temperature that is 15° C. higher than the melting point of the releasing agent, and the shapes of releasing agent particles observed under a transmission electron microscope comprise both rod-like and massive shapes, and the average diameter of the rod-like shapes and the massive shapes is within a range of about 200 to about 1500 nm.

9. The method for producing a toner for electrostatically charged image development of claim 8, wherein the releasing agent contains polyalkylene.

10. The method for producing a toner for electrostatically charged image development of claim 8, wherein at least a polymer of a metal salt is used as the coagulant.

11. The method for producing a toner for electrostatically charged image development of claim 8, wherein the mixed solution further includes a dispersion liquid in which inorganic fine particles are dispersed.

12. An image forming method comprising:

uniformly charging a surface of an image holding member;

forming an electrostatic latent image on the surface of the uniformly charged image holding member based on image information;

developing the electrostatic latent image with a developer containing at least a toner to obtain a toner image; and fusing the toner image on a surface of a recording medium by oilless fusing to form an image on the recording medium;

wherein:

the toner comprising at least a binder resin, a colorant and a releasing agent, and the releasing agent satisfies the following equations (1) and (2):

$$0.1 \leqq \eta^*a \leqq 1.0 \quad (1)$$

$$1.1 \leqq \eta^*b/\eta^*a \leqq 3.5 \quad (2)$$

wherein

η*a represents a complex viscosity (Pa·s) determined from a first dynamic viscoelasticity measurement at a measuring frequency of the releasing agent of 6.28 rad/s, $\eta^*b$ represents a complex viscosity (Pa·s) determined from a second dynamic viscoelasticity measurement at a measuring frequency of the releasing agent of 62.8 rad/s, each of the first and second dynamic viscoelasticities is measured in a temperature range from a temperature that is 15° C. lower than the melting point of the releasing agent to a temperature that is 15° C. higher than the melting point of the releasing agent, and the shapes of releasing agent particles observed under a transmission electron microscope comprise both rod-like and massive shapes, and the average diameter of the rod-like shapes and the massive shapes is within a range of about 200 to about 1500 nm.

* * * * *